US011873181B2

(12) United States Patent
Serpa

(10) Patent No.: US 11,873,181 B2
(45) **Date of Patent: *Jan. 16, 2024**

(54) HIGH SPEED AUTOMATED FEEDING SYSTEM AND METHODS OF USING THE SAME

(71) Applicant: SERPA PACKAGING SOLUTIONS LLC, Covington, KY (US)

(72) Inventor: Fernando Serpa, Visalia, CA (US)

(73) Assignee: SERPA PACKAGING SOLUTIONS LLC, Visalia, CA (US)

( * ) Notice: Subject to any disclaimer, the term of this patent is extended or adjusted under 35 U.S.C. 154(b) by 7 days.

This patent is subject to a terminal disclaimer.

(21) Appl. No.: 17/524,397

(22) Filed: Nov. 11, 2021

(65) Prior Publication Data

US 2022/0169460 A1 Jun. 2, 2022

Related U.S. Application Data

(63) Continuation of application No. 16/589,142, filed on Oct. 1, 2019, now Pat. No. 11,174,113, which is a (Continued)

(51) Int. Cl.
*B65H 3/34* (2006.01)
*B65H 1/04* (2006.01)
(Continued)

(52) U.S. Cl.
CPC ..... *B65H 3/34* (2013.01); *B65H 1/04* (2013.01); *B65H 3/32* (2013.01); *B65H 5/021* (2013.01);
(Continued)

(58) Field of Classification Search
None
See application file for complete search history.

(56) References Cited

U.S. PATENT DOCUMENTS 2,802,529 A 8/1957 Nifong
3,537,934 A 11/1970 Munch
(Continued)

FOREIGN PATENT DOCUMENTS

DE 102007045883 4/2009
EP 0192614 8/1986

OTHER PUBLICATIONS

Focke, English Translation of DE102007045883, provided by WIPO with International Search Report and Written Opinion for Patent Cooperation Treaty Application No. PCT/US17/58893.
(Continued)

*Primary Examiner* — Kavel Singh
(74) *Attorney, Agent, or Firm* — THOMPSON HINE LLP

(57) ABSTRACT

Disclosed is an automated insert feeding system and related methods, capable of removing bulk-packaged items from a tray or other package, and separating the bulk-packaged items individually for distribution into individual packages in high speed reliable fashion. The disclosed systems can also be loaded with multiple packages of the pre-packaged items for automatic feeding into the system which allows human operators to load several packages and allow the system to work unattended, thereby reducing man-hours spend on the process.

24 Claims, 10 Drawing Sheets

Related U.S. Application Data continuation of application No. 15/796,714, filed on Oct. 27, 2017, now Pat. No. 10,427,899.

(60) Provisional application No. 62/413,679, filed on Oct. 27, 2016.

(51) Int. Cl.

| | |
|---|---|
| ***B65H 3/32*** | (2006.01) |
| ***B65H 5/02*** | (2006.01) |
| ***B65H 1/02*** | (2006.01) |
| ***B65H 1/30*** | (2006.01) |
| ***B65H 3/08*** | (2006.01) |
| ***B65H 5/00*** | (2006.01) |

(52) U.S. Cl.

CPC ..... *B65H 1/025* (2013.01); *B65H 1/30* (2013.01); *B65H 3/0808* (2013.01); *B65H 5/006* (2013.01); *B65H 5/023* (2013.01); *B65H 2301/3411* (2013.01); *B65H 2301/4222* (2013.01); *B65H 2301/42265* (2013.01); *B65H 2301/42268* (2013.01); *B65H 2404/264* (2013.01); *B65H 2404/2691* (2013.01)

(56) References Cited

U.S. PATENT DOCUMENTS

| | | | | |
|---|---|---|---|---|
| 3,652,082 | A | | 3/1972 | Eder |
| 3,915,338 | A | | 10/1975 | Kronseder et al. |
| 4,351,679 | A | | 9/1982 | Dreher |
| 4,421,857 | A | | 12/1983 | Guenther et al. |
| 4,895,614 | A | | 1/1990 | Trouteaud et al. |
| 4,966,521 | A | | 10/1990 | Frye et al. |
| 5,119,617 | A | | 6/1992 | Mojden et al. |
| 5,393,181 | A | | 2/1995 | Perego |
| 5,549,434 | A | * | 8/1996 | Perego ..... G11B 15/6885 |
| 5,586,638 | A | | 12/1996 | Mojden et al. |
| 5,713,713 | A | | 2/1998 | Syde et al. |
| 8,167,018 | B2 | | 5/2012 | Haug |
| 2002/0144788 | A1 | | 10/2002 | Shortt |
| 2003/0085102 | A1 | | 5/2003 | Monti |
| 2005/0252599 | A1 | | 11/2005 | Davis et al. |
| 2009/0087296 | A1 | | 4/2009 | May et al. |

OTHER PUBLICATIONS

Guiseppe, English Translation of EP0192614, provided by WIPO with International Search Report and Written Opinion for Patent Cooperation Treaty Application No. PCT/US17/58893.

International Search Report and Written Opinion for Patent Cooperation Treaty Application No. PCT/US17/58893.

* cited by examiner

HIGH SPEED AUTOMATED FEEDING SYSTEM AND METHODS OF USING THE SAME

FIELD OF THE INVENTION

The present invention relates to an insert feeding machine and related methods, and more particularly to an insert feeding machine for pharmaceutical containers, and methods of using and operating the same.

BACKGROUND OF THE INVENTION

Often the packaging process for final consumer facing products includes incorporating into a single package multiple items prepared and manufactured by separate parties. Thus, the party performing final or intermediate packaging steps must take bulk-packaged items provided by other parties in the manufacturing process, such as inserts including leaflet, booklets or other objects, and incorporate them into packaging. Such processes need to be conducted at high speed in the interest of efficiency. Packaging systems are present in the market for such packaging operations, but they require constant observation and loading. Operators of such packaging systems must remain at the machine during operation. Existing insert feeding systems require some sort of operator intervention to open the packages for such items (e.g., trays) before loading the items into the system. These systems also require regular changing out of the parts for running different sized items. In addition, such conventional systems often lose containment of the inserts at one or more locations throughout the process. Such systems typically include friction feeders to deliver the items, which are difficult to keep running consistently at high speeds and with inserts or other items of various thicknesses. These systems include insert "waterfalls" where containment of the insert is lost during a transition from either a vertical or horizontal orientation to the correct orientation to be fed through the belts.

Thus, there is a need for improved systems for high speed, automatic separation and packaging of such items.

SUMMARY OF THE INVENTION

The present invention includes label and insert feeding machines for use in connection with a process of supplying inserts and/or applying labels to containers of various kinds, such as pharmaceutical bottles, jars, boxes, cartons, buckets, and other containers, vitamin bottles, jars, boxes and other containers, food and condiment containers, and various other container types. The label feeding machines of the present invention have improved efficiency, automation, speed, and reliability in comparison to conventional feeding machines. The novel features of the invention prevent long-felt problems with conventional label feeding machines.

The present invention includes a high speed automated insert feeding system operable to be loaded with a queue of trays carrying a large number of inserts or labels ("insert trays") that are to be individually applied to or inserted into a particular kind of container (e.g., a pharmaceutical bottle, jar, or box). The feeding system is operable to open the "insert trays", remove the inserts or labels and maintain them in an ordered column or group, advance the labels to and position them in a magazine that transports them to a novel picking mechanism that grabs the inserts or labels individually and advances them into a belt assembly or other conveying mechanism that delivers the inserts or labels to an application or insertion station or a further conveying system for delivery to an application or insertion station. The feeding system may also be operable to remove the emptied insert trays and advance the next insert tray in the queue to allow the inserts or labels to be removed and advanced through the system. The feeding system therefore allows for a high speed, automated, seamless insert or label loading process that allows a human operator to load several insert trays into a queue for the feeding system without the need to open or otherwise prep the insert trays in any way or for any further operator intervention. The feeding system described herein is operable to pick tray items from the feeder magazine and reliably separate them out at a rate in a range of about 1 to about 10 per second. This is a significant and important innovation over conventional feeding systems that require stripping of the insert trays and hand loading of the inserts or labels.

The feeding system may include the following major components: a tray loading station, a tray opening station, a transfer shuttle, a label or insert feeder magazine, a picking station for separating the labels or inserts individually from the feeder magazine, and an electronic controller for coordinating the functions of each portion of the feeding system. These components are coordinated such that the labels or inserts are continually supplied by the picking station into a conveying mechanism for delivering individual labels or inserts to a downstream application process at high speeds without human operator intervention.

The tray loading station includes an infeed conveyor, which may include a conveying mechanism such as one or more conveying belts that advance toward the tray opening station. The tray loading station may be accessible to a human operator to allow the human operator to load a plurality of insert trays into the tray loading station in quick succession, such that the human operator is not required to monitor the operation of the tray loading station. The tray loading station may have a horizontal orientation and may have sufficient conveying belt length to load several insert trays onto the conveying belt. In some embodiments, the conveying belt of the tray loading station may have a downward slope (e.g., an oblique orientation relative to the horizontal) in order to allow for more conveyor belt length, while minimizing the footprint of the tray loading station. In other embodiments, the tray loading station may have a loadable insert tray magazine (e.g., a vertical magazine) into which multiple insert trays may be loaded. The loadable magazine may be operable to deliver the loaded insert trays in succession to the conveyor belt of the tray loading station as the tray opening station removes the inserts or labels from the preceding insert tray. For example, the insert tray magazine may be an electromechanical device that is operable to place the insert trays loaded therein onto the conveyor belt(s). The magazine may have a port or opening that opens to the conveyor belt(s) and may include an electromechanical actuator that pushes or otherwise moves a loading tray positioned at the end of the magazine at the port or opening onto the conveyor belt(s). In such embodiments, the feeding system may have a timing mechanism or sensor that triggers an electrical signal to the insert tray magazine to activate the electromechanical actuator to place the next insert tray on the conveyor belt(s). The tray loading station may also include guiding mechanisms to position the insert trays in proper position for the tray opening station, such as guiderails along the conveyor belts to keep the insert trays properly aligned. The tray loading station may include other features as well, such as one or more sensors positioned at one or more points along the conveyor belt(s) for detecting the presence of an insert tray, providing position data to the electronic controller, such that the electronic controller is notified that an insert tray is present on the conveyor belt(s).

The insert trays are advanced from the tray loading station to a tray opening station that is operable to open the insert trays (e.g., cutting a tray binding, such as tape, that holds the tray together) such that the inserts or labels therein can be removed and positioned into the insert transfer shuttle. The insert trays may be transferred from the tray loading station to the tray opening station at a receiving mechanism for the insert trays. In some embodiments, the tray loading station may include a waystation that holds the next insert tray in the que until the tray opening station is ready to receive the next insert tray. For example, the waystation may include a motion sensor that sends an electronic signal to the electronic controller to stop the advance of the conveyor belt(s) when the motion sensor detects the presence of the next insert tray. Once the insert tray in the tray opening station has been advanced to the insert transfer shuttle, a signal may be sent to the electronic controller (e.g., by an encoder controlling the movement of the insert transfer shuttle) that notifies the electronic controller to activate the tray loading station to advance the next insert tray, e.g., by activating the conveyor belt(s). The next insert tray may then be advanced to the tray opening station, which may include its own conveying system that advances the insert trays individually to the insert transfer shuttle for removal of the labels or inserts therein and advancement to the insert magazine. The tray opening station may have one or more blades that are positioned laterally along the path of the conveying system that cut binding material (e.g., tape) on the ends of the insert tray, such that the tray can be opened to allow access to the inserts or labels therein by the insert transfer shuttle. The conveying system of the tray opening station may include one or more conveying belt(s), a motorized roller bed, or other conveying mechanism to advance the insert trays. In some embodiments, the conveying mechanism may include one or more grasping or buttressing mechanisms for providing stability to the insert tray as it is advanced through the tray opening station. The one or more grasping or pushing mechanisms may include lugs that are on the conveying mechanism (e.g., conveying belts) that engage the trailing side of the insert tray, clamps that engage the leading and trailing sides of the insert tray, or other mechanism to hold the insert tray steady as it is advanced through the tray opening station. The conveying system advances the insert tray along the one or more blades such that the binding holding the insert tray together is cut and the inserts or labels therein are accessible.

The tray opening station may also include a mechanism for spreading open the insert tray to allow freer access to the labels and inserts in the insert tray. For example, the tray opening station may include a plow structure that is paired with the one or more blades that has a wedge portion that drives the end(s) of the insert tray laterally to spread and open up the insert tray. The tray opening station may having lateral containment structures (e.g., rails) for preventing lateral movement of the insert trays as they are advanced through the tray opening station. The tray opening station may also include an overhead containment mechanism for keeping the insert tray flat on the conveyor as it is advanced through the tray opening station along the one or more blades.

As the insert tray reaches the end of the tray opening station, the insert tray has been opened by the one or more blades. The conveyor advances the insert tray past the one or more blades, and to a collection station within the tray opening station at which the insert transfer shuttle can access and remove the labels or inserts in the insert tray for transfer to the insert feeder magazine. The tray opening station may include an insert tray stop clamp that halts the insert tray on the conveyor system in the collection station such that it is properly positioned for the insert transfer shuttle to retrieve the labels or inserts therein. The stop clamp may be retractable such that it is removed from the path of the insert tray (e.g., below or lateral to the conveying system) after the insert transfer shuttle removes the labels or inserts from the insert tray. Once the labels or inserts are removed from the insert tray, the insert tray may be disposed. For example, the tray opening station conveyor may move the empty insert tray past the collection station once the stop clamp is retracted, and allow it to drop off of the conveying system to remove the empty tray from the system. In other embodiments, the conveying system may include a trap door mechanism for dropping the empty tray out of the system, in which a section of the conveyor tilts in a downward manner. In still further embodiments, the tray opening station may include a motorized picking mechanism for removing the empty tray from the collection station, such as a motorized clamp that grasps a portion of the empty tray and removes it from the collection station for disposal.

The tray opening station may include side guides at the collection station to hold the labels or inserts together after the insert tray is cut and opened. The side guides may be retractable such that they are removed from the collection station after the insert transfer shuttle collects the labels or inserts. The removal of the side guides may facilitate the movement of the labels or inserts from the collection station to the insert feeder magazine by the insert transfer shuttle (e.g., the insert transfer shuttle may move the labels or inserts laterally out of the collection station. In other embodiments, the side guides may be stationary and the insert transfer shuttle may be able to collect the labels or inserts from between the side guides and transport the labels or inserts to the insert feeder magazine (e.g., by lifting the labels or inserts out of the collection station).

The insert transfer shuttle may remove the labels or inserts from the collection station for transport to an insert feeder magazine. The insert transfer shuttle may have containment (collector) paddles that grab the labels or inserts from the insert tray such that the insert transfer shuttle can remove the labels or inserts and transport them to the insert feeder magazine. The containment paddles may be inserted between the side guides of the collection station such that the containment paddles are in contact with each end of a row of labels or inserts. In some embodiments, the side guides retract to allow the insert transport shuttle to move out of the collection station in a lateral direction relative to the conveying system. In other embodiments, the insert transport shuttle may remove the labels or inserts vertically or parallel to the conveying system. The transport shuttle may be motorized (e.g., by a servo motor) and move along a track that aligns the labels or inserts held by the containment paddles to an insert feeder magazine that delivers individual labels or inserts to a picking station. The insert transport shuttle may be retractable to allow the containment paddles to retract away from the insert feeder magazine after it delivers the labels or inserts into the insert feeder magazine. For example, the insert transport shuttle may deliver the labels or inserts along a horizontal plane, and orthogonally (e.g., vertically) retract from the insert feeder magazine.

The movement of the transfer shuttle along its track may be controlled by the electronic controller. The transfer shuttle may include a servo motor and an encoder in electronic communication with the electronic controller, such that the movement of the transfer shuttle may be directed by the electronic controller. The encoder of the transfer shuttle may provide data on the position of the transfer shuttle along its track, and the electronic controller may be operable to change the position of the transfer shuttle to a desired position.

The feeder magazine may include a motorized advancement bar or finger that runs along a second track that is parallel to the track of the transfer shuttle, and that is operable to be positioned at the trailing end of the row of tray items in the feeder magazine and advance the tray items through the feeder magazine. The advancement bar or finger may be actuated by a servo motor and an encoder that are in electronic communication with the electronic controller, such that the movement of the motorized bar or finger may be directed by the electronic controller. The encoder of the advancement bar or finger may provide data on the position of the advancement bar or finger along its track, and the electronic controller may be operable to change the position of the transfer shuttle to a desired position. The position data provided by the encoders of the transfer shuttle and the advancement bar or finger allow the electronic controller to coordinate the movement of the transfer shuttle and advancement bar such that the transfer shuttle advances the tray items into the feeder magazine until the leading end of the row of tray items reaches the position of the advancement bar at the trailing end of the tray items that were previously loaded into the feeder magazine. For example, once the electronic controller determines from the encoder data of the transfer shuttle and the advancement bar that the leading of the transfer shuttle and the advancement bar are in the same place, the electronic controller may send a signal to the servo of the advancement bar to (1) retract from feeder magazine and move the advancement bar to the position of the trailing end of the transfer shuttle, (2) reinsert the advancement bar into the feeder magazine just behind or adjacent to the trailing paddle of the transfer shuttle, and (3) apply a constant pressure to the trailing tray item to aid in advancing the tray items through the feeder magazine (the advancement bar may have an additional insertion/retraction actuator that is controlled by the electronic controller and operable to insert the advancement bar into the feeder magazine and retract it therefrom). When the encoder data from the advancement bar indicates to the electronic controller that the advancement finger is positioned at substantially the same position as the trailing paddle of the transfer shuttle, the electronic controller may signal the transfer shuttle to (1) retract its paddles from feeder magazine and move along its track to the collection station, to collect a new row of tray items, (2) lower the paddles between the side guides in the collection station, and (3) advance the transfer shuttle to the position of the advancement bar, and the steps may then be recycled to continually supply tray items into the feeder magazine.

The insert feeder magazine may include a track in which the labels or inserts are confined such that they remain aligned to facilitate advancement through the insert feeder magazine without labels or inserts becoming dislodged and/or stuck in a position in the insert feeder magazine, and blockage of the insert feeder magazine is avoided. The insert feeder magazine may have a track or pathway having a shape that is complementary to the perimeter shape of the labels or inserts to keep the row of labels, inserts, or blisterpacks in a uniform, aligned row. In some embodiments, the track or pathway of the insert feeder magazine may have one or more adjustable walls that may be moved to adjust the size and shape of the track or pathway to accommodate labels, inserts, blisterpacks, or other items of various dimensions. For example, the track or pathway may have a lateral wall or side that may be moved inward to position the lateral wall parallel to the previous position such that an interior dimension of the track or pathway is reduced (e.g., the width of the track or pathway may be smaller) to accommodate smaller items within the track or pathway. As a further example, the track or pathway may have a bottom wall or side that may be moved outward to position the bottom wall parallel to the previous position such that an interior dimension of the track or pathway is increased (e.g., the height of the track or pathway may be larger) to accommodate larger items within the track or pathway.

The insert feeder magazine may be operable to deliver labels or inserts individually to a picking station without blockage or disablement of the insert feeder magazine, and without dropping or double-feeding labels or inserts to the picking station. The insert feeder magazine may include a driving mechanism that conveys the labels or inserts positioned in the insert feeder magazine toward the picking station at a distal end of the insert feeder magazine. The driving mechanism may be a motorized bar or finger that is advanced at the back of the line of labels or inserts loaded in the insert feeder magazine. In other embodiments, the insert feeder magazine may include a conveying belt or roller bed that advances the labels or inserts through the feeder insert magazine. In still further embodiments, all or a portion of the insert feeder magazine may be positioned at a downward pitch such that gravity drives or aids in driving the advancement of the labels or inserts toward the picking station.

The insert feeder magazine may include a distal portion located in proximity to the picking station. The distal portion may include additional features that aid in controlling the delivery of the labels, inserts, blisterpacks, or other items to the picking location in a consistent, individual manner, such that a picking mechanism that removes the items from the feeder magazine is successful each time it engages to remove an item, with no blockages of the insert feeder magazine or dropped or otherwise lost items from the feeder magazine. The distal portion of the insert feeder magazine may have a downward slope, such that gravity aids in advancing the labels, inserts, blisterpacks, or other items to the picking station. In some embodiments, the entire length of the track or pathway may have a downward slope. In some embodiments, the track or pathway may have multiple downward slopes of varying pitches, wherein the pitch of the track or pathway changes at one or more points (e.g., the track or pathway may have a progressively increasing downward slope).

The distal portion of the insert feeder magazine may also include an arresting mechanism to arrest the movement of the labels or inserts within the insert feeder magazine and keep the labels and inserts in a uniform, orderly arrangement (e.g., a tight row of labels or inserts) in the insert feeder magazine. The labels or inserts should be kept in an orderly arrangement in the insert feeder magazine such that they are delivered in the proper orientation, one at a time to the picking station. The arresting mechanism may hold the labels or inserts in position by frictional engagement with the labels or inserts, and be operable to alternately engage and disengage from the labels or inserts at pre-determined intervals or upon receiving signals from an electronic controller. For example, the insert feeder magazine may include one or more frictional clamps that apply increased pressure to (squeeze) the labels, inserts, blisterpacks, or other items in the track or pathway of the insert feeder magazine to prevent forward advancement of the items in the track or pathway during the picking operation, when the picking mechanism engages the leading label, insert, blisterpack, or other item in the track or pathway and removes it from the insert feeder magazine. The arresting mechanism may be operable to apply sufficient pressure to (1) prevent movement of the labels, inserts, blisterpacks, or other items in the track or pathway during the picking operation, and (2) prevent the penultimate item or any of the items trailing it from dislodging or falling from the insert feeder magazine during the picking operation. The pressure applied by the arresting mechanism may not be such that it prevents the leading item from being removed from the insert feeder magazine by the picking mechanism during the picking operation. In some embodiments, the arresting mechanism may be one or more of the one or more adjustable walls of the insert feeder magazine, where the electronic controller sends a signal to the actuator for the one or more adjustable walls to compress the track or pathway a limited amount, e.g., by reducing a dimension (e.g., the width) of the track or pathway by a predetermined amount (e.g., a predetermined amount in a range of about 0.5 mm to about 3 mm). In other embodiments, the distal portion of the insert feeder magazine may include a clamp or other structure (e.g., a clamp positioned over the distal portion of the insert feeder magazine that is actuated to compress the labels, inserts, blisterpacks, or other items in the track or pathway during the picking operation. The clamp or other structure may apply a predetermined pressure (e.g., a predetermined pressure in a range of about 0.5 PSI to about 5 PSI) to one or more sides of the labels, inserts, blisterpacks, or other items in the track or pathway.

The distal portion of the insert feeder magazine may also include a stop tab, bar, or other structure that prevents the leading label, insert, blisterpack, or other item from exiting the distal end of the insert feeder magazine between picking operations. The stop tab may include a contact portion that sits in front of the leading label, insert, blisterpack, or other item in the track or pathway between the picking operation to prevent the leading item from falling out of the insert feeder magazine prior to the next picking operation. The stop tab may be a bar, pin, plate, or other structure that may be positioned in front of the leading item in the insert feeder magazine between picking operations and then retracted during the picking operation. The stop tab may extended and retracted by a stop tab actuator that is controlled by electronic signals from the electronic controller. The actuating mechanism of the stop tab actuator may be a pneumatic, electronic motor-driven (e.g., by a servo or other electronic motor), or other actuation mechanism.

The picking mechanism may be a mechanism operable to grasp, drag, and/or push the leading label, insert, blisterpack, or other item, remove it from the track or pathway, and transport the item into a receiving receptacle or conveying system. In some embodiments, the picking mechanism may include a grasping structure that is operable to be placed on the outward facing surface of the leading item and create a partial vacuum between the grasping structure and the outward surface of the item such that a seal is created and the partial vacuum allows the grasping structure to pull the leading item out of the insert feeder magazine during the picking operation. The grasping structure may be one or more conical or cup structures that can contact the item such that the entire perimeter of the one or more conical or cup structures is in contact with the outward side of the item, and a seal may be achieved when air is removed from between the grasping structure and the outward side of the item. The grasping structure may include an airtight conduit running from the interior of the grasping structure to a vacuum generator, such as a pneumatic cylinder or motor operable to evacuate air from the grasping structure (e.g., a centrifugal fan motor, or other appropriate motor). The grasping structure may be flexible and resilient to facilitate the formation of a seal between the grasping structure and the leading label, insert, blisterpack, or other item, even in the case that the grasping structure and the outward surface of the leading item are not perfectly parallel at initial contact during the picking operation.

The picking mechanism may also include one or more articulating arms having one or more joints therein. The grasping structure may be attached to the one or more articulating arms. Together the grasping structure and the one or more articulating arms may be operable to pull the leading label, insert, blisterpack, or other item in a forward direction out of the insert feeder magazine and then direct the leading item in a second direction to deliver the leading item into a conveying system or receptacle. For example, the one or more articulating arms may be connected to a rotating cam and follower system spun by a rotary motor. In such examples, the one or more articulating arms are connected to the rotating cam and are rotated and extended with each rotation of the cam such that, with each rotation of the cam, the grasping structure is delivered to the picking station for engaging the leading item and then articulating arms pull the leading item from the insert feeder magazine and deliver it to a receiving receptacle or conveying system. In some examples, the vacuum generator may continuously provide suction to the grasping structure. In such examples, the receiving receptacle or conveying system may include a mechanism for removing the leading item from the grasping structure, such as conveying belts that strip the item from the grasping structure, or a claw or catch against which the item is contacted to dislodge it from the grasping structure. In other examples, the vacuum generator is activated as the grasping mechanism delivered to the picking station and is then deactivated when the articulating arm delivers the leading item to the receiving receptacle or conveying system.

In other examples, the articulating arm may pull the leading item in pivoting motion (e.g., laterally, vertically, inferiorly, etc.) to slide the leading item into a receptacle or conveying system in close proximity to the picking station. In other embodiments, the grasping structure may be a paddle, finger or other structure having a material thereon that has a high coefficient of friction in contact with the outward surface of the labels, inserts, blisterpacks, or other items, and the grasping structure may pull the leading item from the insert feeder magazine by dragging the leading item in a parallel direction (e.g., downward, laterally, etc.) to the receiving receptacle or conveying system, such that the grasping mechanism maintains a high friction contact between it and the leading item.

The picking operation involves the cooperative operation of several elements, including the arresting mechanism, the stop tab, and the picking mechanism. These elements may be coordinated such that (1) the arresting mechanism engages the labels, inserts, blisterpacks, or other items and (2) the stop tab disengages the leading label, insert, blisterpack, or other item, immediately before a picking operation begins, (3) the picking mechanism places the grasping structure on the outward facing surface of the leading item immediately after the stop tab disengages the leading item and a seal is created between the grasping structure and the leading item, and (4) the one or more articulating arms pulls the leading item from the insert feeder magazine. These coordinated steps help to ensure that the labels, inserts, blisterpacks, or other items in the inserter feeder magazine are removed from the feeder magazine individually, one at a time. In some embodiments, the feeder system may include a conveyor in close proximity to the picking station and may assist in the picking process. In such embodiments, the one or more articulating arms may pull the leading item from the feeder magazine, and the conveying system may have a retractable belt pulley which may be extended from a backend conveying assembly and strip the leading item from the grasping structure and feed it into the backend conveying assembly for delivery to a receiving receptacle or to another process. In other embodiments, the one or more articulating arms may move the leading label, insert, blisterpack or other item to a receiving station of the backend conveying system (e.g., a containment belt conveyor) and the back end conveying system may then deliver the item to a receiving receptacle or to another process.

The feeder system may include an electronic controller that is in electronic communication with the tray opening station, the insert transfer shuttle, the components of the insert feeder magazine, the picking station and mechanism, and the backend conveying system. These elements of the feeder system may each include their own actuating systems (e.g., servo motors, pneumatic actuators, centrifugal motors, etc.) that are controlled by the electronic controller. The electronic controller may be programmed with an algorithm governing the activation and coordination of each step in the feeder system process. An exemplary process may include:

a. A human operator loading the tray of the label, insert, blisterpack, or other item in the receiving section of the tray opening station, which may be, e.g., a horizontal conveyor, or a magazine for feeding onto a conveyor.
b. The electronic controller advancing the trays until a leading tray reaches a sensor located at a waystation, a signal is then sent to the electronic controller to indicate that a tray is present;
c. The electronic controller activates a second conveyor having one or more grasping or pushing mechanisms which may include lugs that engage the leading tray and advance it past the one or more blades that are positioned laterally along the path of the second conveyor to cut the bindings of the tray and a plow to spread the ends of the tray to allow access to the row of items therein;
d. The opened tray then reaches a collection station which includes a stop clamp that halts the advance of the leading tray and retractable side guides for containing the row of labels, inserts, blisterpacks, or other items;
e. The electronic controller then signals the actuator (e.g., servo motor) for the insert transfer shuttle to move to the collection station and lower its containment paddles (which are spaced apart according to the length of the row of labels, inserts, blisterpacks, or other items in the tray) such that the containment paddles are positioned at each end of the row of items in the tray and between the side guides;
f. The electronic controller may then signal the an actuator for the side guides (e.g., an electronically controlled pneumatic actuator, electrical motor, etc.) to retract to allow the insert transfer shuttle to move the items laterally, and the electronic controller may then activate the motor of the insert transfer shuttle (e.g., a servo motor that moves the shuttle along a track) to deliver the tray items to the insert feeder shuttle;
g. Once the tray items are delivered into the feeder shuttle, a motorized bar or finger may be positioned at the trailing end of the row of tray items to advance them through the feeder magazine, and the electronic controller may signal the transfer shuttle to return to the collection station to retrieve a new row of tray items;
h. The advancement bar advances the tray items to the distal end of the feeder magazine where they are positioned one at a time in the picking station;
i. During a picking operation, the electronic controller (1) signals an actuator of an arresting mechanism (e.g., a pneumatic actuator) in the distal end of the feeder mechanism to apply pressure to the tray items, (2) signals the actuator (e.g., a pneumatic actuator) of a stop tab to retract from the picking station and provide access to the picking head, (3) signals the actuator of a picking mechanism to move its picking head into position in contact with the leading tray item in the picking station, (4) activates a vacuum generator to evacuate a grasping structure on the picker head to create a partial vacuum between the grasping mechanism and the leading tray item, and (5) move the picking arm in a manner that removes the leading tray item from the feeder magazine. Steps 1-5 may be finely coordinated such that they are always conducted in order and in such rapid succession that a picking operation may be conducted at a rate in a range of 1 to 10 picking operations per second;
j. Once the tray item is removed from the feeder magazine, the tray items may be delivered by the picking mechanism to a receiving receptacle or conveyor. Alternatively, a backend conveyor may be present, and it may have a mechanism (e.g., a belt pulley) for grabbing the tray item from the picking mechanism and advancing the tray item through the conveyor.

Generally, the operational method of the present invention may include inserting packages (e.g., trays) of the pre-packaged items in the loading station. The loading station conveyor advances the full packages to the transport lug conveyor which advances the tray to the package opening station. Once passed through the package opening station, the opened package is advanced to the collection position, where a motorized transfer shuttle may move into place to collect the exposed pre-packaged items. The collection station includes side guides that maintain the pre-packaged items in a uniform formation in the collection position until the transfer shuttle collects the pre-packaged items. The side guides may be retracted from the collection position once the transfer shuttle has collected the pre-packaged items. The horizontal transfer shuttle then removes the pre-packaged items from the package and transports them toward the feeder magazine. Once the pre-packaged items positioned in the feeder magazine, a back pressure advancement bar moves into place at the back of the trailing item in the feeder magazine, and advancement bar applies pressure to the trailing pre-packaged item to advance the items through the feeder magazine. The transfer shuttle may then retract from the feeder magazine and move back into position at the collection position to remove pre-packaged items from the next package in a queue of packages loaded by the operator. The advancement bar may remain in place until the pre-packaged items are transported to distal portion of the feeder magazine (e.g., a sloped gravity magazine). The advancement bar then moves back into position to receive the next row of pre-packaged items from the transfer shuttle.

As the pre-package items reach the end of the feeder magazine, a pick head having a vacuum grasping mechanism moves into position at a picking station and picks the leading pre-packaged item from the feeder magazine. An overhead stop tab is removed just before the pick head removes the leading pre-packaged item. There may also be friction side clamps that engage the pre-packaged items in the feeder magazine to prevent the pre-packaged items from spilling out of the feeder magazine after the pick head removes the leading pre-packaged item. After the leading pre-packaged item is removed from the feeder magazine, the overhead stop tabs reengage to contain the pre-packaged items in the feeder magazine and the friction side clamps may retract to allow the row of pre-packaged items to advance toward the pick location. The leading pre-packaged item removed by the pick head may be transferred to backend conveying system for transfer to an individual container or package or to a further conveying system.

The methods according to the present invention may include variations therein. For example, rather than the tray item removed from the picking station being placed into a backend conveying system, it may be deposited by the picking mechanism into a carton, bucket, or other (e.g., final) container. As a further example, the next tray in the queue may be held at a second waystation on the second conveyor (prior to entering the collection station), while the following trays in the queue may be held collectively at a first waystation on the initial conveyor. The electronic controller may advance the next tray to the collection station once the encoder data from the transfer shuttle indicates that the collection station is clear of the previous tray items. Further variations in the systems and methods are contemplated with the scope of the present invention as well. It is to be understood that the examples provided herein are exemplary and do not limit the scope of the present invention.

In one aspect, the present invention relates to a system for separating and feeding tray-packed items individually, comprising a collection station for removing a row of pre-packaged items from a package; a transfer shuttle operable to grasp each end of the row and transport the row to a feeder magazine; a feeder magazine having a track for receiving the row of pre-packaged items; a driving mechanism for advancing the row of pre-packaged items through the track; and picking station operable to perform a picking operation which removes the pre-packaged items individually from the feeder magazine that includes an arresting mechanism for preventing the advancement of the row of pre-packaged items, a stop tab operable to hold a leading pre-packaged item in the feeder magazine, and a picking mechanism operable to remove the leading pre-packaged item from the feeder magazine and deliver the pre-packaged item to a backend conveying system or a container, wherein the system is operable to perform the picking operation in repetition to separate the pre-packaged items and deliver them individually to the backend conveying system or the container.

In a second aspect, the present invention relates to a system for separating and feeding tray-packed items individually, comprising a feeder magazine having a track for receiving a row of pre-packaged items, a driving mechanism for advancing the row of pre-packaged items through the track, and picking station operable to perform a picking operation which removes the pre-packaged items one at a time from the feeder magazine, comprising: an arresting mechanism for preventing the advancement of the row of pre-packaged items, a stop tab operable to hold a leading pre-packaged item in the feeder magazine, and a picking mechanism operable to remove the leading pre-packaged item from the feeder magazine and deliver the pre-packaged item to a backend conveying system or a container, wherein the system is operable to perform the picking operation in repetition to separate the pre-packaged items and deliver them individually to the backend conveying system or the container.

In a further aspect, the present invention relates to a method for separating and feeding pre-packaged items individually, comprising: loading a plurality of packages into a loading station on automated feeding system, the package comprising a plurality of pre-packaged items, transferring one of the plurality of packages to a collection station; removing the plurality of pre-packaged items from the one package with a transfer shuttle operable to grasp the plurality of pre-packaged items; transporting the plurality of pre-packaged items to a feeder magazine; and delivering the plurality of pre-packaged items to a picking station through the feeder magazine, where the plurality of pre-packaged items are removed from the feeder magazine individually.

The above-described objects, advantages and features of the invention, together with the organization and manner of operation thereof, will become apparent from the following detailed description when taken in conjunction with the accompanying drawings, wherein like elements have like numerals throughout the several drawings described herein. Further benefits and other advantages of the present invention will become readily apparent from the detailed description of the preferred embodiments.

DETAILED DESCRIPTION

Reference will now be made in detail to certain embodiments of the invention, examples of which are illustrated in the accompanying drawings. While the invention will be described in reference to these embodiments, it will be understood that they are not intended to limit the invention.

To the contrary, the invention is intended to cover alternatives, modifications, and equivalents that are included within the spirit and scope of the invention. In the following disclosure, specific details are given to provide a thorough understanding of the invention. However, it will be apparent to one skilled in the art that the present invention may be practiced without all of the specific details provided.

The present invention concerns high speed automated insert feeding system, operable to be loaded with multiple trays of labels, leaflets, inserts, blisterpacks, or other bulk-packaged items that need to be separated individually and placed in or attached to separate containers or packages. The packages of these bulk-packaged items (e.g., sealed trays of labels, leaflets, inserts, or blisterpacks) are loaded into a feeding system that is operable to automatically feed the packages one-by-one into the apparatus which removes the bulk-packaged items from their package and transfers them to an apparatus for feeding the bulk-packaged items to a conveyor or to an individual container or package. Operators can now load several trays of inserts at a time and leave the machine while it automatically feeds them into the insert feeder magazine. The high speed automated insert feeding system also includes a powered bulk-packaged item magazine which advances the items to a picking station where the items are reliable removed one-at-a-time from the magazine at high speed. The inserts may be transferred onto a conveyor or directly into cartons, buckets or other containers from the picking station.

Figure 1:
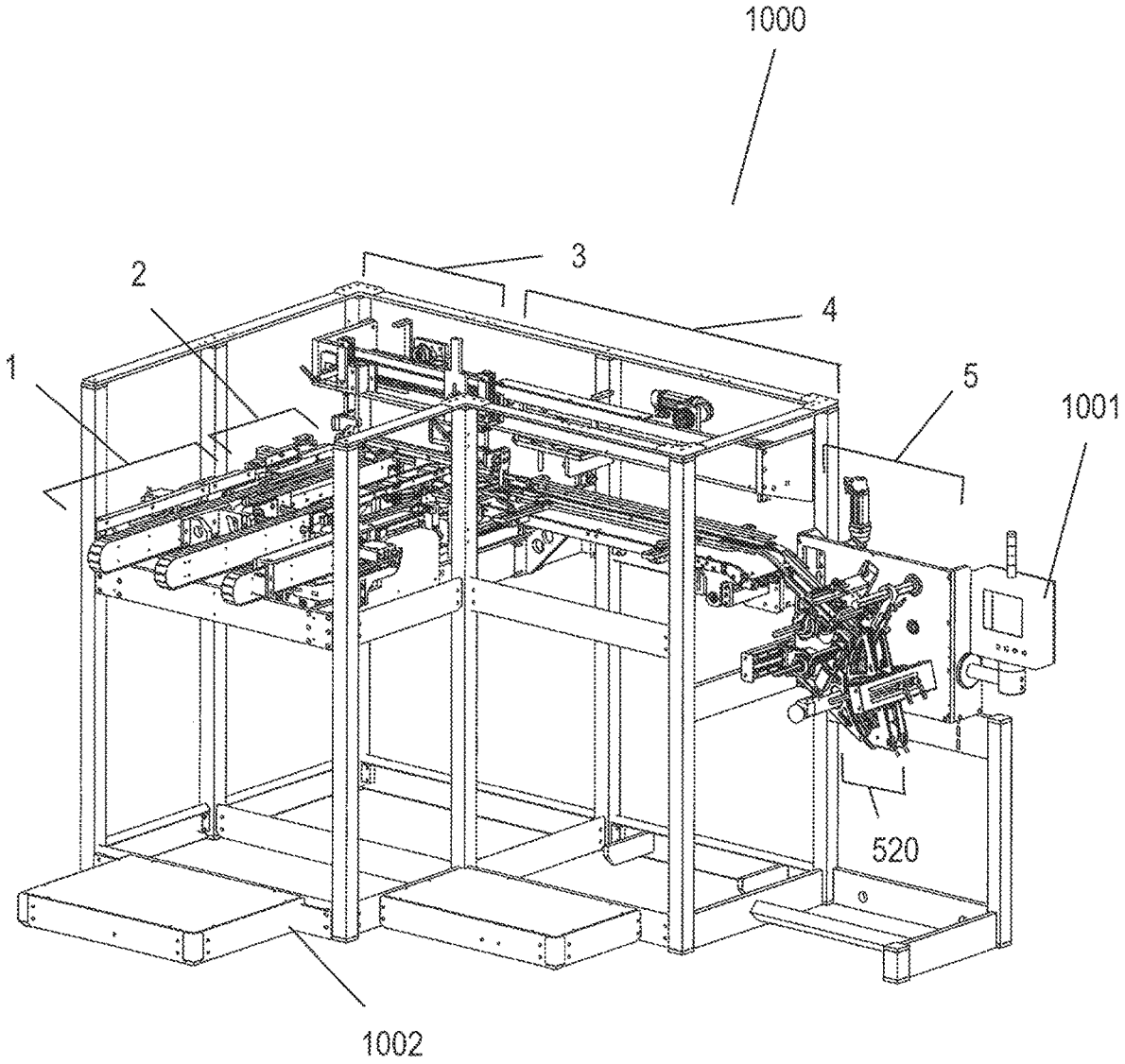
FIG. 1 shows a perspective view of an automated feeding system according to an embodiment of the present invention.

FIG. 1 shows an exemplary feeding system 1000 for separating and feeding labels, leaflets, inserts, blisterpacks, or other bulk-packaged items for inclusion in or attachment to individual packages. The feeding system 1000 includes several sections, including a loading station 1, a tray opening station 2, a collection station 3, the feeder magazine 4, and the picking assembly 5, which includes a backend conveying assembly 520 that receives the items individually from the picking assembly 5. The feeding system also include an electronic controller 1001, which may include a microprocessor and memory, and may be connected to the electronic elements in each section of the feeding system. The electronic controller 1001 may be programmed with one or more algorithms that govern the operation of the electronic components of the feeding system. The feeding system 1000 may also include a frame 1002 on which the sections of the feeding system are mounted and connected to facilitate proper operation of the machine.

Figure 2:
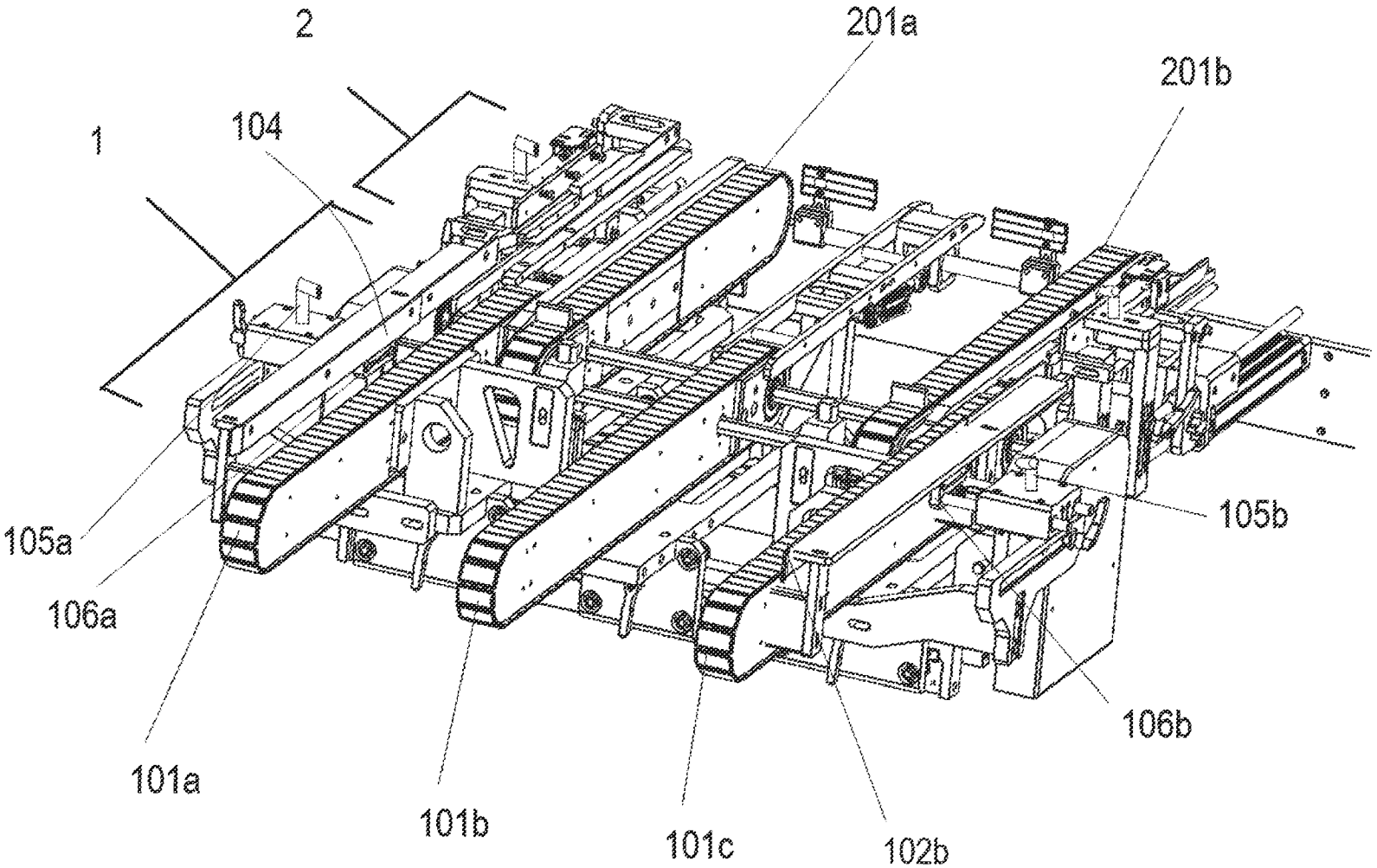
FIG. 2 shows a perspective view of a loading station and a package opening station according to an embodiment of the present invention.

FIG. 2 shows an up-close view of the loading station 1 and the tray opening station 2, with the remaining sections of the feeding system 1000 removed for the sake of clarity. The loading station 1 includes three conveyors 101*a*, 101*b*, and 101*c* on which an operator may load a plurality of packages (e.g., trays) of bulk-packaged items to be separated. The outer conveyors 101*a* and 101*c* may be flanked by side-rail guides 102*a* and 102*b* respectively. In some embodiments, the distance between the side-rail guides 102*a* and 102*b* may be adjustable to accommodate packages of different widths. The loading station 1 may also include a waystation 104 for halting the plurality of packages in order to control the advance of the plurality of packages through the feeding system 1000. The way station 104 may include one or more sensors 105*a* and 105*b*, which may be motion sensors, density sensors, or other sensors operable to sense the presence of a package at the position of the waystation 104. The sensors 105*a* and 105*b* may be in electronic communication with the electronic controller 1001 and provide data regarding the presence of a package in the waystation 104. The waystation 104 may also include pressure clamps 106*a* and 106*b* that have electronically controlled actuators (e.g., an electronically controlled pneumatic actuator). The actuators for the pressure clamps 106*a* and 106*b* may be in electronic communication with the electronic controller 1001, and the may be activated by the electronic controller 1001 when a package is detected in the waystation 104 by the sensors 105*a* and 105*b*. The electronic controller 1001 may also take into account additional data from other sensors in the feeding system when determining whether to activate the actuators of the pressure clamps 106*a* and 106*b*, such as whether there is a package present in a waystation in the package opening station 2, whether there is a package present in the collection station 3, whether the feeder magazine 4 is full, and other data. If there is a package detected in a second waystation in the package opening station 2, the electronic controller will engage the pressure clamps 106*a* and 106*b* when a package is detected in the waystation 104. In some embodiments, if there is a package in the collection station 3 and the feeder magazine 4 is full or substantially full, the electronic controller 1001 will engage the pressure clamps 106*a* and 106*b* when a package is detected in the waystation 104. Other conditions of the feeder system 1000 may result in the electronic controller 1001 engaging the pressure clamps 106*a* and 106*b* when a package is detected in the waystation 104, such as if there is a malfunction in the feeder system 1000 downstream of the loading station 1. In other embodiments, the plurality of packages may be halted by stopping the conveyors 101*a*, 101*b*, and 101*c* when a package is detected in the waystation 104. In such embodiments, the electronic controller 1001 may use the same data and criteria to determine whether to halt the packages by temporarily shutting down the conveyors.

Figure 3:
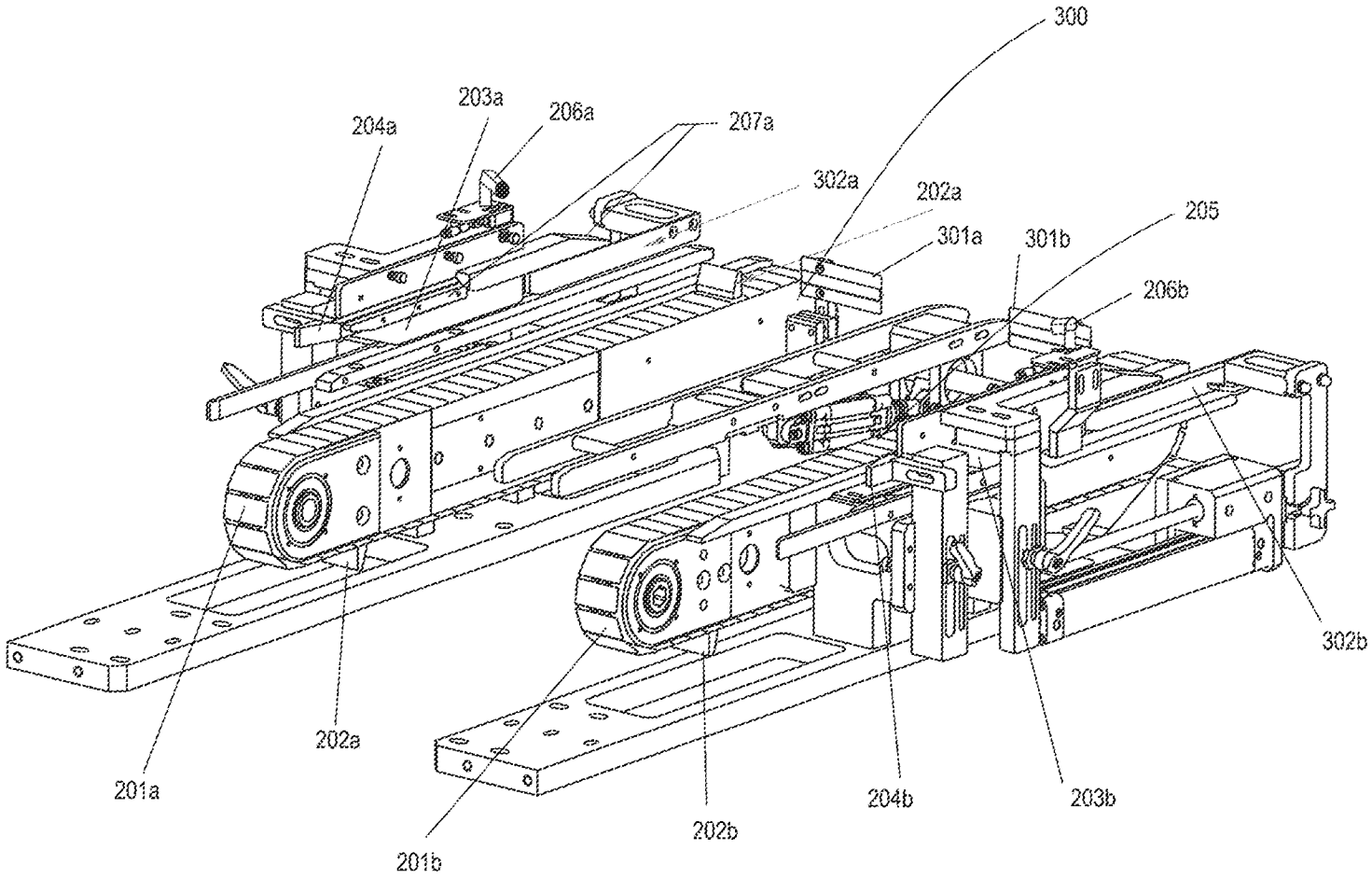
FIG. 3 shows a perspective view of a package opening station according to an embodiment of the present invention.

As shown in FIG. 2, the conveyors 101*a*, 101*b*, and 101*c* overlap with conveyors 201*a* and 201*b* of the package opening station 2, allowing the packages to seamlessly transition between the stations. As shown in FIG. 3, the conveyors 201*a* and 201*b* are operable to advance the packages through cutting and spreading assemblies located along the lateral sides of the conveying path (FIG. 3 shows the tray opening station with the remaining sections of the feeding system 1000 removed for the sake of clarity). The conveyors 201*a* and 201*b* may have laterally aligned pairs of lugs 202*a* and 202*b* that engage the trailing side of the package and aid in pushing the package through the cutting and spreading assemblies, which present some resistance to the advance of the package. The cutting and spreading assemblies may each include a vertically oriented blade (203*a* and 203*b*) to cut open the ends of the package and a plow (204*a* and 204*b*) to push the ends of the packages outward to expose the packaged items therein. The cutting and spreading assemblies may also include overhead guides (207*a* and 207*b*) for containing the items near the ends of the package in their position and preventing spillage or dislodging of the items.

At or near the distal end of the cutting and spreading assemblies, the package opening station 2 may include a second waystation 205, which may include one or more sensors 206*a* and 206*b*, which may be motion sensors, density sensors, or other sensors operable to sense the presence of a package at the position of the waystation 205. The sensors 206*a* and 206*b* may be in electronic communication with the electronic controller and provide data regarding the presence of a package in the waystation 205. The package may be halted by stopping the conveyors 201*a* and 201*b* when a package is detected in the waystation 205. The conveyors 201*a* and 201*b* may be in electronic communication with the electronic controller 1001, and the may be deactivated by the electronic controller when a package is detected in the waystation 205 by the sensors 206*a* and 206*b*. The electronic controller 1001 may also take into account additional data from other sensors in the feeding system when determining whether to deactivate the conveyors 201*a* and 201*b*, such as whether there is a package present in the collection station 3, whether the feeder magazine 4 is full, and other data. If there is a package detected in the collection station 3, the electronic controller 1001 will deactivate the conveyors 201*a* and 201*b* when a package is detected in the waystation 205. In some embodiments, if the feeder magazine 4 is full or substantially full, the electronic controller 1001 will deactivate the conveyors 201*a* and 201*b* when a package is detected in the waystation 205. Other conditions of the feeder system 1000 may result in the electronic controller 1001 deactivating the conveyors 201*a* and 201*b* when a package is detected in the waystation 205, such as if there is a malfunction in the feeder system 1000 downstream of the package opening station 2. In other embodiments, the waystation 205 may also include pressure clamps (not shown) that have electronically controlled actuators (e.g., an electronically controlled pneumatic actuator). In such embodiments, the electronic controller 1001 may use the same data and criteria to determine whether to halt the packages by engaging the actuators for the pressure clamps.

After advancing past the waystation 205, the package is advanced by conveyors 201*a* and 201*b* to a collection position 300 in the collection station 3, where the leading side of the package is halted by stop clamps 301*a* and 301*b* to hold the package in the collection position 300. When positioned against the stop clamps 301*a* and 301*b*, the package is in proper orientation for the transfer shuttle to access and extract the items from the package. The collection station 3 may also include side guides 302*a* and 302*b* that maintain the lateral items in the opened tray in their position and to prevent spillage or dislodging of the items.

Figure 4:
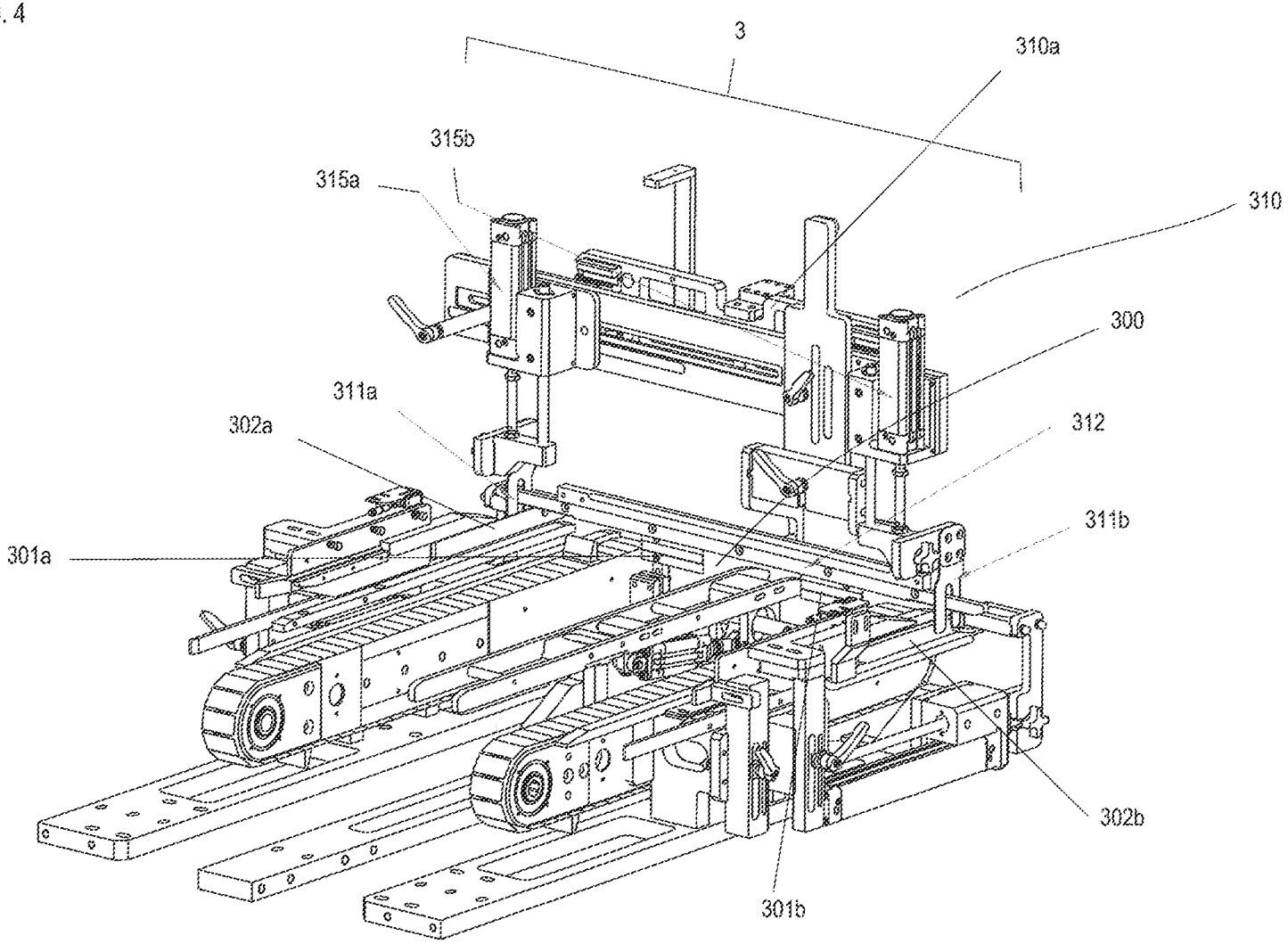
FIG. 4 shows a perspective view of a package opening station and a collection station according to an embodiment of the present invention.

As shown in FIG. 4, a transfer shuttle 310 is operable to be positioned over the collection position 300 in the collection station 3 (FIG. 4 shows the tray opening station 2 and the collection station 3 with the remaining sections of the feeding system 1000 removed for the sake of clarity). The transfer shuttle 310 may include vertically retractable end paddles 311*a* and 311*b* that may be lowered into the collection position 300 on either side of the items of the package present in the collection position 300. The transfer shuttle 310 may also include an overhead guide 312 for preventing vertical dislodging of the items. The end paddle 311*a* may be positioned at the trailing end of the row of items in the package and the end paddle 311*b* may be positioned at the leading end of the row of items in the package. The end paddles 311*a* and 311*b* may be lowered next to the side guides 302*a* and 302*b*, for example, just outside of the side guides 302*a* and 302*b*. In other examples, the end paddles 311*a* and 311*b* may be positioned between the side guides and the ends of the row of items. The end paddles 311*a* and 311*b* may each be moved along a vertical path by an electronically controlled actuator (e.g., a double action pneumatic air cylinder) that is in electronic communication with the electronic controller 1001. Actuators 315*a* and 315*b* may be activated by the electronic controller 1001 to be retracted vertically or inserted inferiorly depending on data provided to the electronic controller 1001. For example, the electronic controller 1001 may receive position data from the transfer shuttle assembly 310 by an encoder that tracks the movement and position of the transfer shuttle 310. When the electronic controller 1001 receives position data for the transfer shuttle 310 that indicates that the transfer shuttle 310 is position over the collection position 300, the electronic controller 1001 may activate the actuators 315*a* and 315*b* to lower the end paddles 311*a* and 311*b* to be positioned at the ends of the items in the package.

Once the end paddles 311*a* and 311*b* are positioned at the ends of the items, the side guides 302*a* and 302*b* may be retracted to allow the transfer shuttle 310 to move the items laterally to the feeder magazine 4. The side guides 302*a* and 302*b* may have electronically controlled actuator (e.g., a pneumatic actuator) that is in electronic communication with the electronic controller 1001. The electronic controller 1001 may activate the actuators for the side guides 302*a* and 302*b* to retract the side guides from the collection position 300 after (1) the electronic controller 1001 receives position data from the transfer shuttle assembly 310 that the transfer shuttle 310*a* is positioned over the collection position 300 and (2) the electronic controller 1001 has activated the paddle actuators 315*a* and 315*b* to lower the paddles 311*a* and 311*b* into the collection position 300.

The stop clamps 301*a* and 301*b* may also be retractable. After the transfer shuttle 310 moves the items out of the opened package to the feeder magazine, the opened and empty package must be removed from the collection position 300. To allow the removal of the opened package, the stop clamps 301*a* and 301*b* may be retracted such that they do not block the path of the conveyors 201*a* and 201*b*. The stop clamps 301*a* and 301*b* may be operable, e.g., to be retracted below the path of the conveyors 201*a* and 201*b*. The stop clamps 301*a* and 301*b* may each have an electronically controlled actuator (e.g., a pneumatic actuator) that is in electronic communication with the electronic controller 1001. The electronic controller 1001 may activate the actuators for the stop clamps 301*a* and 301*b* to retract the stop clamps from the collection position 300 after the electronic controller 1001 receives position data from the transfer shuttle assembly 310 that the transfer shuttle 310*a* is removed from the collection position 300. The conveyors 201*a* and 201*b* may advance the opened package past the collection station 300 such that it falls of the conveyors 201*a* and 201*b*, e.g., into a refuse container.

Figure 5:
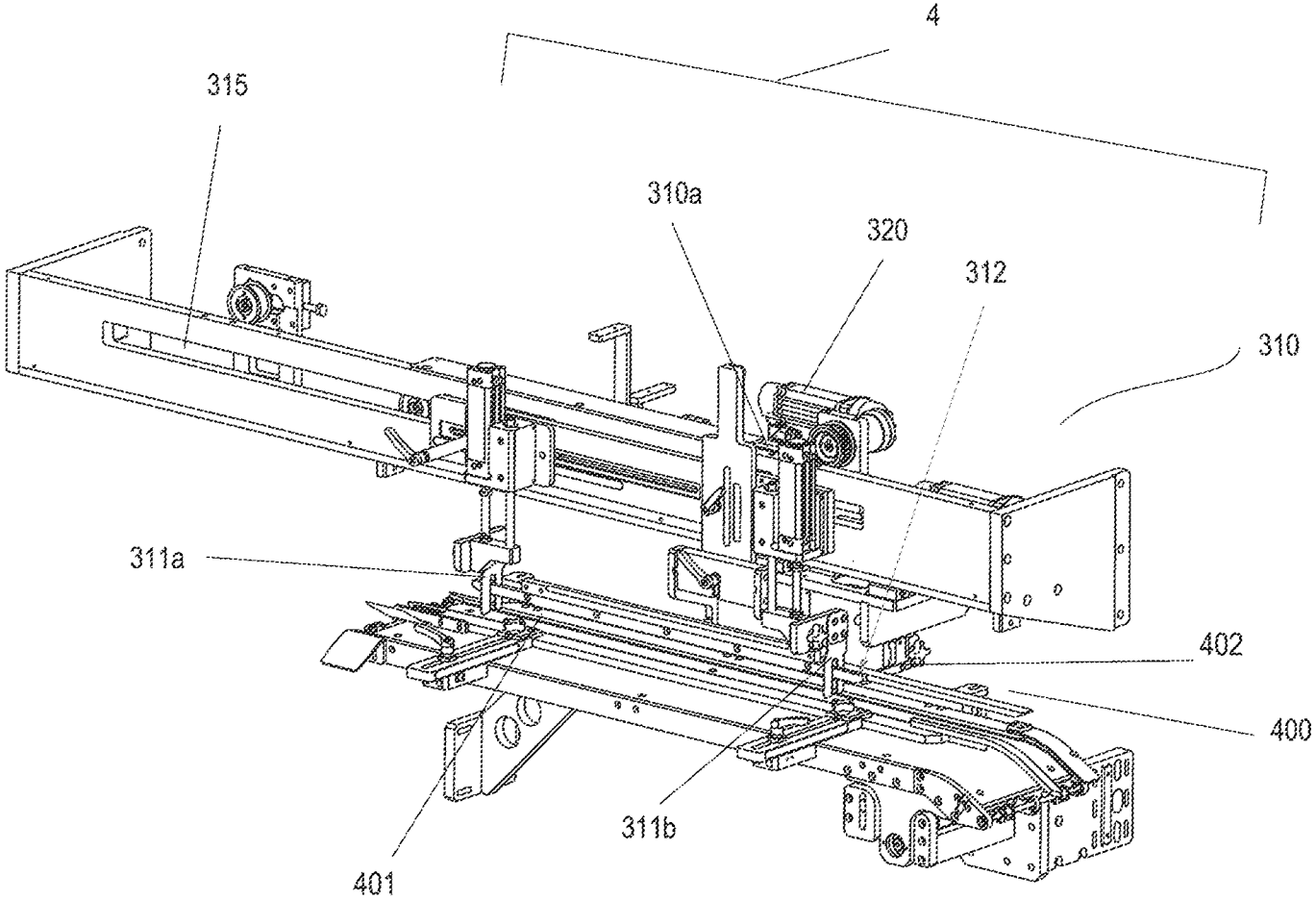
FIG. 5 shows a perspective view of a transfer shuttle assembly and a feeder magazine according to an embodiment of the present invention.

FIG. 5 shows the feeder magazine section 4 of the feeding system 1000 and the transfer shuttle assembly 310 positioned thereover, with the remaining sections of the feeding system 1000 removed for the sake of clarity. The transfer shuttle 310*a* moves along track 315 to transfer the packaged items from the collection position 300 into the feeder magazine 400. The transfer shuttle assembly 310 includes a motor 320 (e.g., a servo motor) that may use a belt or chain system to move the transfer shuttle 310*a* back and forth along the track 315 between the collection position 300 and the feeder magazine 4. The transfer shuttle assembly 310 may also include an encoder that tracks the position and movement of the transfer shuttle 310 along the track 315. The encoder may be in electronic communication with the electronic controller 1001 and provide the position data to the electronic controller 1001.

The transfer shuttle 310*a* delivers the items collected from the collection position 300 and transfers them laterally to a proximal portion 401 of the feeder magazine 400. The proximal portion 401 may be in alignment with the collection position 300 such that the transfer shuttle 310*a* can make a straight-line lateral motion to deliver the items into the proximal portion 401 of the feeder magazine 400. In other embodiments, the transfer shuttle assembly may be configured to pivot, elevate, and/or perform other motions to align the items with the feeder magazine 400, based on the arrangement of the components of the feeding system. The feeder magazine 400 may be empty or it may have items loaded therein from a previous package in the queue. If the feeder magazine 400 is empty, the transfer shuttle 310*a* advances the items until the transfer shuttle 310*a* reaches the distal-most point of the track 315. In such instances, the items are positioned in the feeder magazine 400 such that the leading item is positioned near the end of the proximal portion 401 of the feeder magazine 400. In instances where there are items already loaded in the feeder magazine 400, the transfer shuttle 310*a* advances the items to the point where the leading item held with the end paddle 311*b* is positioned immediately adjacent to the trailing item of the previously loaded items.

After the transfer shuttle 310*a* places the transferred items in the feeder magazine 400, an advancement bar 402 is positioned behind the trailing item, and applies pressure to the trailing item to advance the items through the feeder magazine 400. The advancement bar 402 that runs along a second track that is parallel to the track 315, and that is operable to be positioned at the trailing end of the row of tray items in the feeder magazine 400 and advance the items through the feeder magazine 400. The advancement bar 402 may be actuated by a motor (e.g., servo motor) and an encoder that are in electronic communication with the electronic controller 1001, such that the movement of the advancement bar 402 may be directed by the electronic controller 1001. The advancement bar 402 may have an additional insertion/retraction actuator (e.g., an electronically controlled pneumatic actuator) that is controlled by the electronic controller 1001 and operable to insert the advancement bar 402 into the feeder magazine 400 and retract it therefrom.

The encoder of the advancement bar 402 may provide data on the position of the advancement bar 402 along its track, and the electronic controller 1001 may be operable to change the position of the transfer shuttle 310*a* to a desired position. The position data provided by the encoders of the transfer shuttle 310*a* and the advancement bar 402 allow the electronic controller 1001 to coordinate the movement of the transfer shuttle 310*a* and advancement bar 402 such that the transfer shuttle 310*a* advances the items into the feeder magazine 400 until the leading end of the row of items reaches the position of the advancement bar 402 at the trailing end of the items that were previously loaded into the feeder magazine 400. For example, once the electronic controller 1001 determines from the encoder data of the transfer shuttle 310*a* and the advancement bar 402 that the leading of the transfer shuttle 310*a* and the advancement bar 402 are in the same place, the electronic controller 1001 may send a signal to the motor of the advancement bar 402 to (1) retract from feeder magazine 400 and move the advancement bar 402 to the position of the trailing end of the transfer shuttle 310*a*, (2) reinsert the advancement bar 402 into the feeder magazine 400 just behind or otherwise adjacent to the trailing paddle 311*a* of the transfer shuttle 310*a*, and (3) apply a constant pressure to the trailing item to aid in advancing the items through the feeder magazine 400. When the encoder data from the advancement bar 402 indicates to the electronic controller 1001 that the advancement bar 402 is positioned at substantially the same position as the trailing paddle 311*a* of the transfer shuttle 310*a*, the electronic controller 1001 may signal the transfer shuttle 310*a* to (1) retract its paddles 311*a* and 311*b* from feeder magazine 400 and move along its track 315 to the collection station 300, to collect a new row of items from the next package in the queue, (2) lower the paddles 311*a* and 311*b* next to the side guides 302*a* and 302*b* in the collection station 300, and (3) advance the transfer shuttle 310*a* to the position of the advancement bar 402, and the steps may then be recycled to continually supply a new row of items into the feeder magazine 400.

Figure 6:
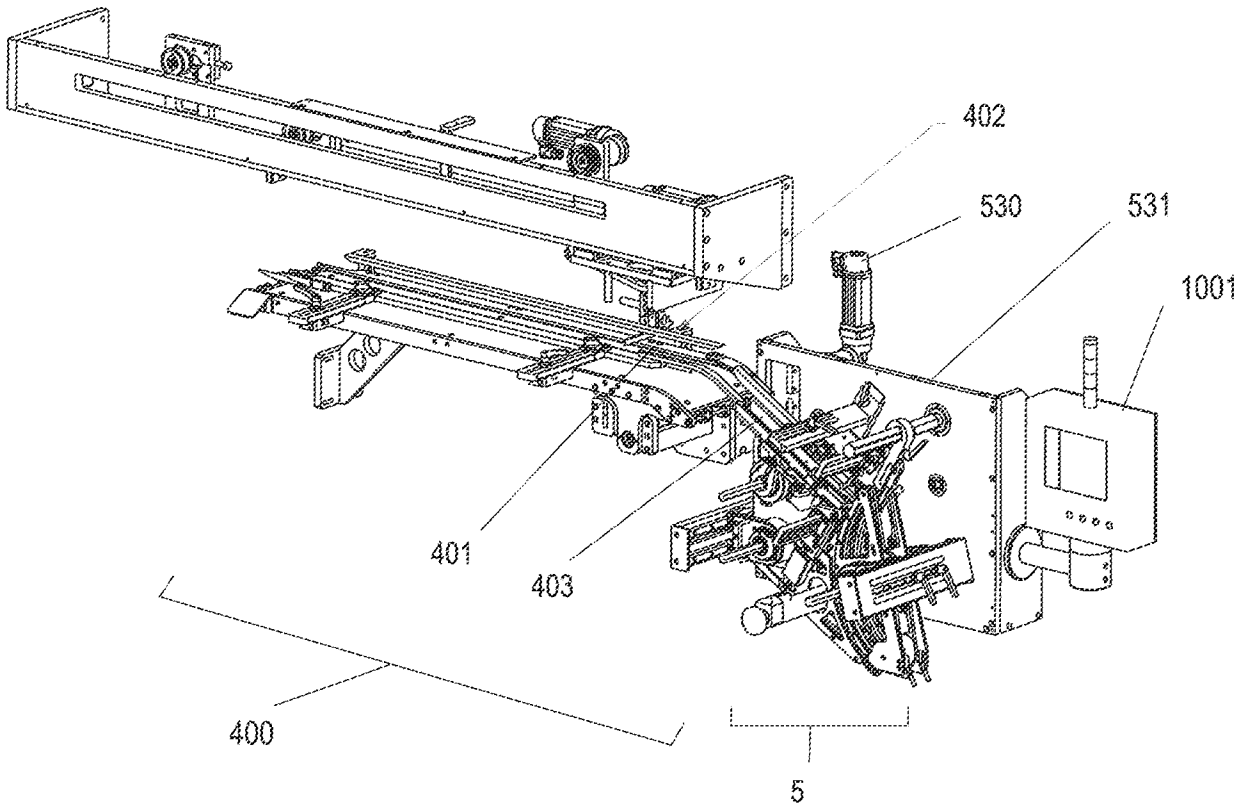
FIG. 6 shows a perspective view of a transfer shuttle assembly, a feeder magazine, and a picking assembly according to an embodiment of the present invention.

FIG. 6 shows the feeder magazine section 4 of the feeding system 1000 and the picking assembly 5, with the remaining sections of the feeding system 1000 removed for the sake of clarity. As can be seen from FIG. 6, the feeder magazine 400 may include a proximal section 401 that receives items from the transfer shuttle 310*a* and a distal portion 403 that feeds items into the picking assembly 5. In the embodiment shown in FIG. 6, the proximal portion 401 of the feeder magazine 400 is horizontal to facilitate horizontal transfer of the items by the transfer shuttle 310*a* from the collection station 300 to the proximal portion 401 of the feeder magazine 400 in order to allow for efficient movement of the items with shortest transfer distance and the least motion. The distal portion 403 of the feeder magazine 400 may have a different orientation than the proximal portion 401, where the distal portion 403 has a downward slope to allow gravity to aid in pushing the items toward a picking station. The distal portion 403 may have a length that is shorter than a row of the pre-packaged items such that the leading item of a row of items from an initial package in a queue reaches the picking station at the end of the distal portion 403 of the feeder magazine 400 when the advancement bar 402 advances to near the end of the proximal portion 401 of the feeder magazine. In such embodiments, the advancement bar 402 does not need to advance into in the distal portion 403 of the feeder magazine 400, and can be maintained in a horizontal track along the proximal portion 401. This arrangement avoids any opportunities for gaps or "waterfalls" in the row of pre-packaged items as they are advanced to the distal portion of the feeder magazine 400, since pressure is continually applied to the trailing item in the row of pre-packaged items. In other embodiments, the entire feeder magazine 400 may have a single continuous slope along which the advancement bar 402 may move back and forth from a proximal entry point of the feeder magazine 400 to the distal most point at a picking station. In other embodiments, the feeder magazine 400 may have multiple slopes therein and the advancement bar 402 may be operable to move back and forth along the entire feeder magazine 400 with the advancement bar track following the changes in slope in the feeder magazine.

The distal portion 403 of the feeder magazine may deliver items into the picking assembly where the items may be individually removed from the feeder magazine 400 to separate the pre-packaged items for distribution to individual packages. The picking assembly may be mounted on a stationary mount 531. The picking assembly 5 may include a motor 530 that drives the individual components of the picking assembly 5 through a belt system situated in the mount 531. The belt system may closely coordinate the movement of the individual components of the picking assembly 5 such that the picking assembly 5 can be run reliably at high speeds, allowing it to perform picking operations at a rate in a range of about 1 to about 10 picking operations per second.

Figure 7:
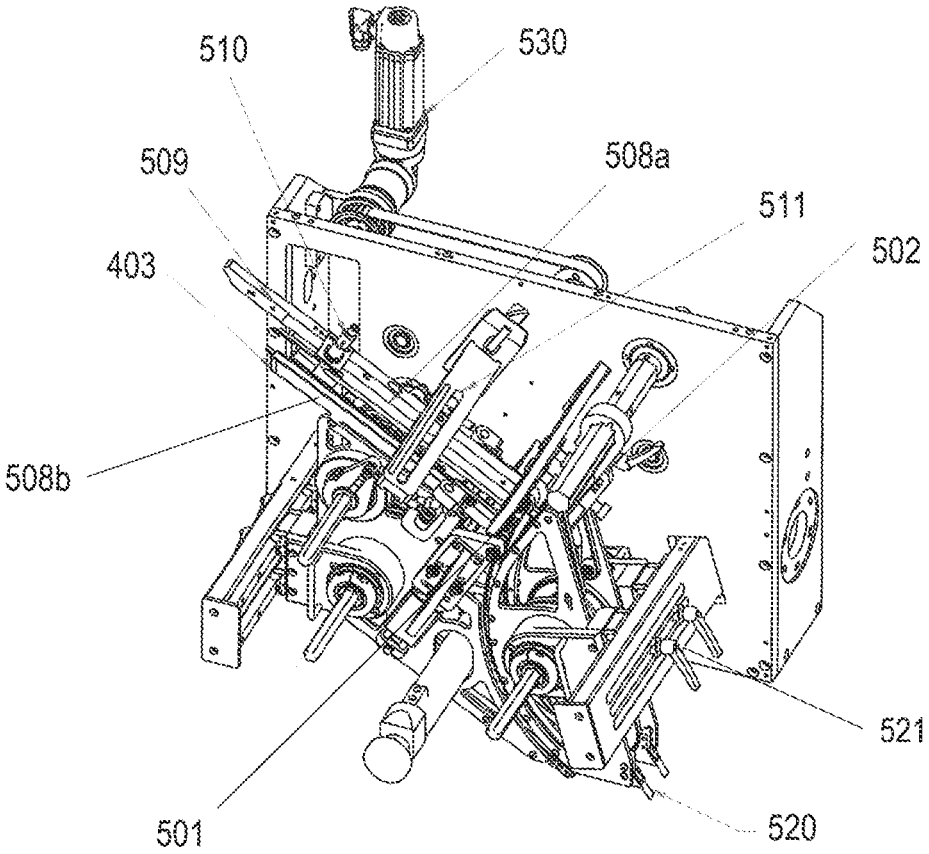
FIG. 7 shows a perspective view of a picking assembly according to an embodiment of the present invention.

FIG. 7 shows an up-close view of the picking assembly 5, with the remaining sections of the feeding system 1000 removed for the sake of clarity. The distal portion 403 of the feeder magazine 400 feeds the pre-packaged items into the picking assembly 5 at a downward slope toward the picking location 501, taking advantage of gravity to move the pre-packaged items forward. The picking assembly 5 may include at least one chute sensor 510 positioned at the distal portion 403 of the feeder magazine 400 for detecting whether there are pre-packaged items in the distal portion 403. The at least one chute sensor 510 may be a motion sensor, density sensor, or other sensor operable to sense the presence of pre-packaged items in the distal portion 403 of the feeder magazine 400. The at least one chute sensor 510 may be in electronic communication with the electronic controller 1001 and provide data regarding the presence of a pre-packaged items in the distal portion 403 of the feeder magazine 400. The data from the at least one chute sensor 510 allows the electronic controller 1001 to both activate the picking assembly when pre-packaged items are initially positioned in the distal portion 403 of the feeder magazine 400, and to deactivate the picking assembly 5 when the data from the chute sensor(s) 510 indicates that there are no pre-packaged items at the position of the chute sensor(s) 510. The algorithm of the electronic controller 1001 for controlling the operation of the picking assembly 5 may be calibrated such that the electronic controller 1001 runs a specific number of the picking operations after it receives data form the chute sensor(s) 510 that there are no pre-packaged items at the position of the chute sensor(s) 510—the number of pre-packaged items in the distal portion 403 between the chute sensor(s) 510 and the picking station 501 may be known, allowing the electronic controller to direct the picking assembly to run a pre-determined number of picking operations for the remaining pre-packaged items.

The distal portion 403 of the feeder magazine 400 includes sidewalls 508*a* and 508*b*, and an overhead guide 509 to contain the pre-packaged items in a tight, uniform row as they are advanced through the distal portion 403. At least one of the sidewalls 508*a* and 508*b* may be adjusted to accommodate pre-packaged items of different sizes (e.g., different widths). The distal portion 403 of the feeder magazine 400 may include a width adjustment mechanism 511 that allows the width of the distal portion 403 to be modified. The width adjustment mechanism 511 may be manually and/or automatically adjusted by the electronic controller 1001. It may be manually adjusted by a locking screw or other manually operated mechanism, and/or automatically adjusted by an electronically controlled actuator (e.g., a pneumatic actuator) in electronic communication with the electronic controller 1001. For example, the internal width of the distal portion 403 may have discrete preprogrammed settings that may be selected from a user interface of the electronic controller 1001.

As the pre-packaged items reach the picking station 501, they may be removed one-by-one during a picking operation by the picking head 502. The removed item may then be transferred from the picking head 502 to a backend conveying system 520 that transmits the items one-at-a-time to an individual package or a further conveying system. The conveying system 520 may be a belt conveying system that sandwiches the pre-packaged items between two belts. The gap between the two belts of the conveying system 520 may also be adjusted to accommodate pre-packaged items of thicknesses. The conveying system 520 may include a gap adjustment mechanism 521 that allows the size of the gap between the belts of the conveying system 520 to be modified. The gap adjustment mechanism 521 may be manually and/or automatically adjusted by the electronic controller 1001. It may be manually adjusted by one or more locking screws or other manually operated mechanism, and/or automatically adjusted by an electronically controlled actuator (e.g., a pneumatic actuator) in electronic communication with the electronic controller 1001. For example, the size of the gap may have discrete preprogrammed settings that may be selected from a user interface of the electronic controller 1001.

Figure 8:
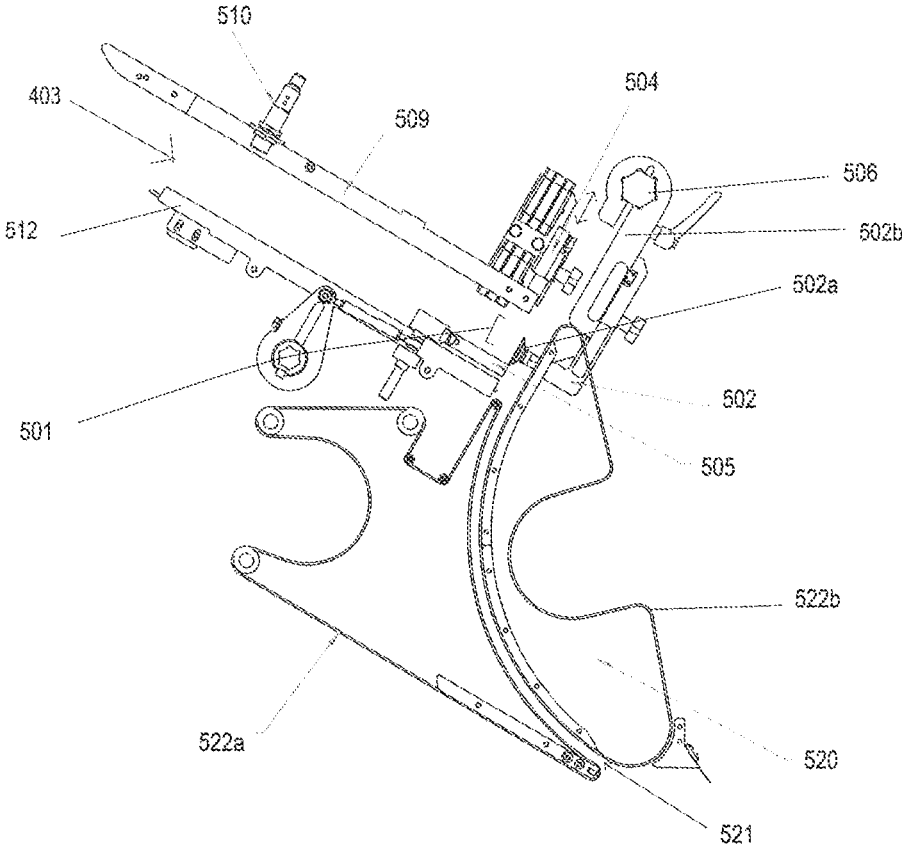
FIG. 8 shows a side view of components of a picking assembly according to an embodiment of the present invention.

FIG. 8 provides a side view of the internal components of the picking station 501, with the remaining sections of the feeding system 1000 removed for the sake of clarity. The prepackaged items are delivered down the distal portion 403 of the feeder magazine 400 to the picking station 501, where the leading pre-packaged item is removed by picking head 502. The picking station 501 may include an arresting mechanism to frictionally engage the pre-packaged items to hold them in position during a picking operation. The arresting mechanism may be one or more frictional clamps 505 positioned laterally to the feeder magazine 400 that are moved medially inward into the feeder magazine 400 to engage the lateral sides of the pre-packaged items. The frictional clamps 505 may be driven by the integrated belt system driven by the motor 530, such that the timing of the engagement of the frictional clamps 505 is mechanically governed in precise, coordinated manner with the other components of the picking station 501. In other embodiments, the frictional clamps 505 may include electronically controlled actuators (e.g., pneumatic actuators) that are in electronic communication with the electronic controller 1001, and the electronically controller 1001 activates the actuators for the frictional clamps 505 with precise timing coordinated with the other components of the picking station 501 according to a pre-programmed algorithm.

The picking station 501 may also include at least one stop tab 504 that blocks the advancement of the pre-packaged items between picking operations. Between picking operations, the arresting mechanism (frictional clamps 505) may be disengaged to allow the pre-packaged items to advance in the feeder magazine 400, and the at least one stop tab 504 may be engaged to prevent the leading pre-packaged item or any others from spilling from the feeder magazine 400. The at least one stop tab 504 may be a bar or plate that moves orthogonally relative to the path of the distal portion 403 of the feeder magazine 400 as shown by the arrow in FIG. 8, and is inserted to obstruct the distal end of the distal portion 403 the feeder magazine 400 to hold the leading pre-packaged item in the feeder magazine 400 between picking operations. During the picking operation, the at least one stop tab 504 may be removed from the path of the feeder magazine 400 after the arresting mechanism (frictional clamps 505) frictionally engages the pre-packaged items in the feeder magazine 400. The at least one stop tab 504 may be driven by the integrated belt system driven by the motor 530, such that the timing of the engagement of the at least one stop tab 504 is mechanically governed in precise, coordinated manner with the other components of the picking station 501. In other embodiments, the at least one stop tab 504 may include electronically controlled actuators (e.g., pneumatic actuators) that are in electronic communication with the electronic controller 1001, and the electronically controller activates the actuators for the at least one stop tab 504 with precise timing coordinated with the other components of the picking station 501 according to a pre-programmed algorithm.

The picking head 502 may include a pivoting arm 502*a* that moves into and out of the picking station 501 with a pivoting motion to grasp and remove the leading pre-packaged item from the feeder magazine 400. Movement of the pivoting arm 502*a* may be driven by an axle 506 that rotates clockwise during a picking operation to move the picking head 502 into the picking station 501 and then rotates counterclockwise between picking operations to remove the picking head 502 from the picking station 501. The axle 506 may be driven by the integrated belt system driven by the motor 530, such that the timing of the rotation of the axle 506 is mechanically governed in precise, coordinated manner with the other components of the picking station 501. In other embodiments, the axle may include an electronically controlled actuator (e.g., a servo motor or pneumatic actuator) that is in electronic communication with the electronic controller 1001, and the electronically controller activates the actuator for the axle 506 with precise timing coordinated with the other components of the picking station according to a pre-programmed algorithm.

The picking head 502 may also include a grasping cup 502*a* at its distal end that is operable to be placed on the outward facing surface of the leading item and create a partial vacuum between the grasping cup 502*a* and the outward surface of the item such that a seal is created and the partial vacuum allows the picking arm 502 to pull the leading item out of the feeder magazine 400 during the picking operation. The grasping cup 502*a* may be one or more conical or cup structures that can contact the leading item at the picking station 501 such that the entire perimeter of the one or more conical or cup structures is in contact with the outward side of the item, and a seal may be achieved as air is removed from between the one or more conical or cup structures and the outward side of the item. The grasping cup 502*a* may include an airtight conduit running from the interior of the grasping cup 502*a* to a vacuum generator, such as a motor operable to evacuate air from the grasping cup 502*a* (e.g., a centrifugal fan motor, or other appropriate motor). The suction created by the vacuum generator may be constantly applied to the grasping cup 502*a*. The grasping cup 502*a* may be flexible and resilient to facilitate the formation of a seal between the grasping cup 502*a* and the leading label, insert, blisterpack, or other item, even in the case that the grasping cup 502*a* and the outward surface of the leading item are not perfectly parallel at initial contact during the picking operation.

Each picking operation involves the cooperative operation of several elements, including the arresting mechanism (frictional clamps 505), the stop tab 504, and the picking head 502. These elements may be coordinated such that (1) the arresting mechanism 505 engages the labels, inserts, blisterpacks, or other items and (2) the stop tab 504 disengages the leading label, insert, blisterpack, or other item, immediately before a picking operation begins, (3) the picking head 502 places the grasping cup 502*a* on the outward facing surface of the leading item immediately after the stop tab 504 disengages the leading item and a seal is created between the grasping structure and the leading item, and (4) the picking head 502 pulls the leading item from the insert feeder magazine 400. These coordinated steps help to ensure that the labels, inserts, blisterpacks, or other items in the inserter feeder magazine are removed from the feeder magazine individually, one at a time.

After the picking operation, the backend conveying system 520 receives the picked pre-packaged item from the picking head 502. The backend conveying system 520 may be in close proximity to the picking station 501 and may assist in the picking process. After the picking head 502 pulls the leading item from the feeder magazine 400, and the conveying system may have a pair of belts 522*a* and 522*b* that bilaterally flank the picking head 502 positioned such that the pre-packaged item attached to the grasping cup 502*a* contacts the pair of belts 522*a* and 522*b* as the picking head 502 rotates counter-clockwise away from the picking station 501. As the pre-packaged item hits the pair of belts 522*a* and 522*b*, the belts 522*a* and 522*b* strip the pre-packaged items from the grasping cup 502*a* and pull the pre-packaged item along the belts 522*a* and 522*b* until it enters the gap 521 between the belts 522*b* and 522*a* to be conveying to an individual package or to a further conveying system.

Figure 9:
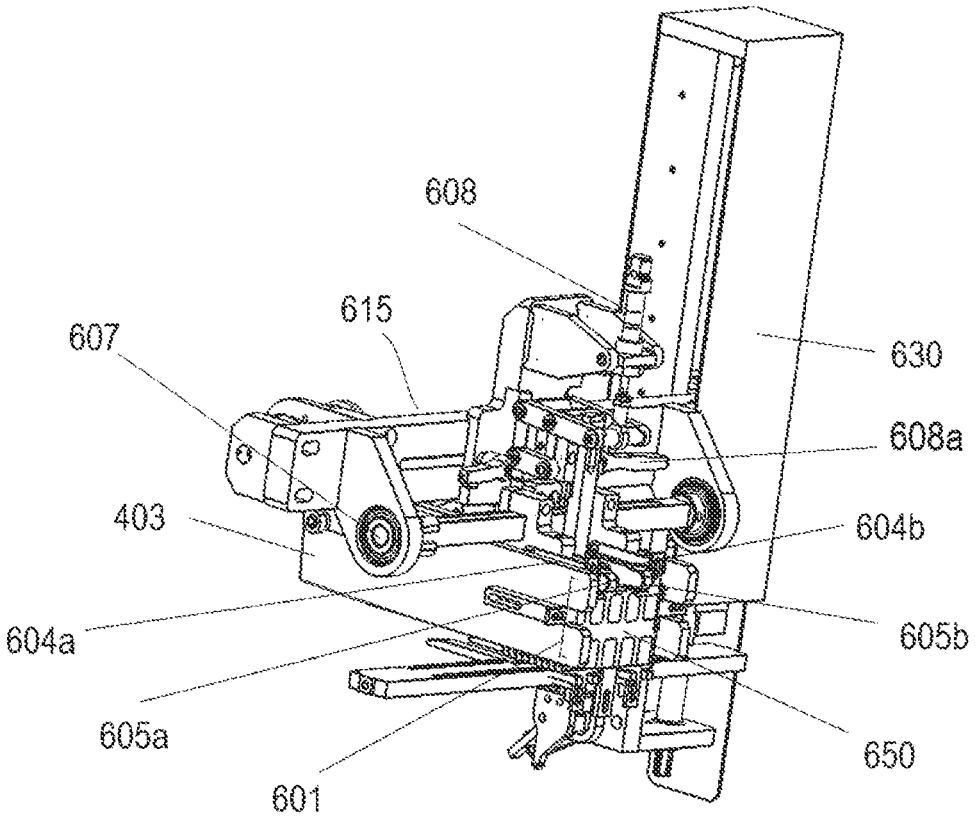
FIG. 9 shows a perspective view of components of a picking assembly according to an embodiment of the present invention.
Figure 10:
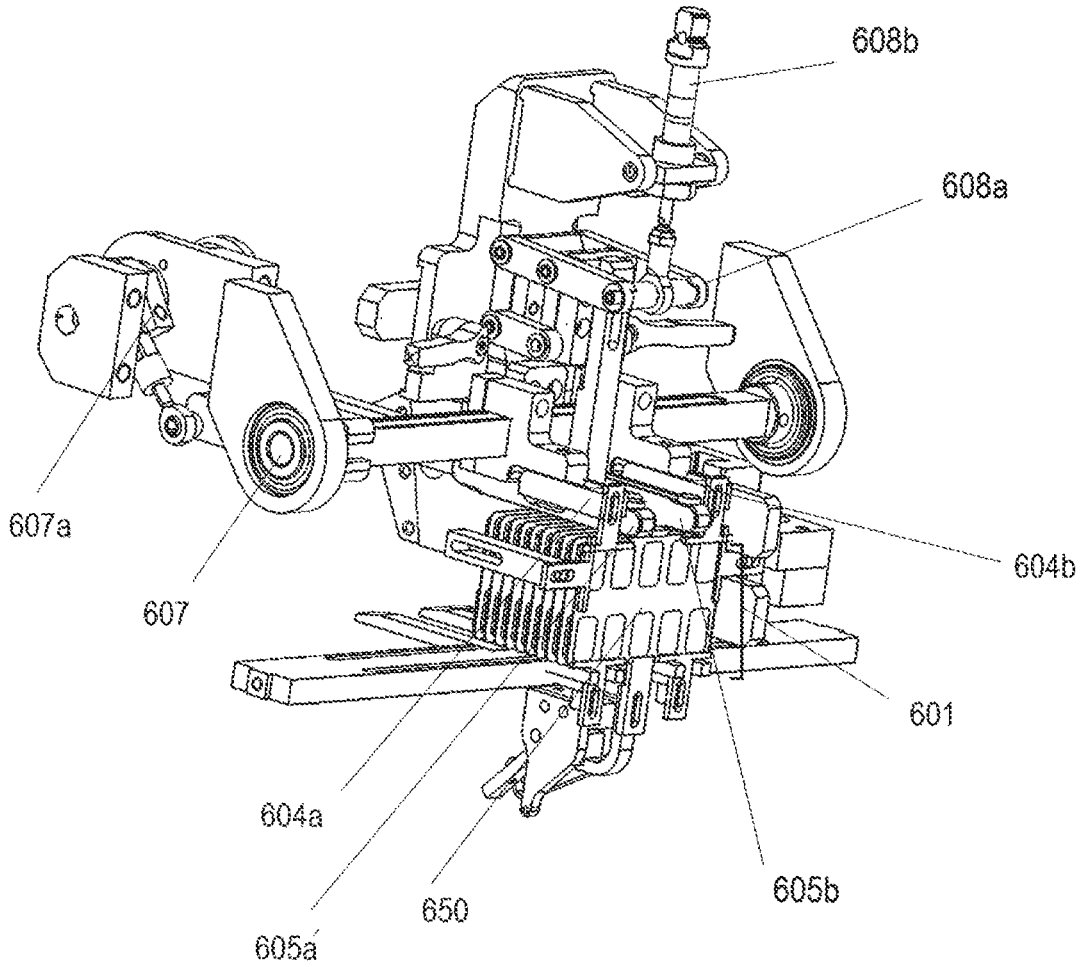
FIG. 10 shows a perspective view of components of a picking assembly according to an embodiment of the present invention.

FIGS. 9-10 show an alternative design for several of the components in the pick assembly, with the remaining sections of the feeding system 1000 removed for the sake of clarity. The arrangement of the components of the arresting mechanism and the stop tab different than the embodiment shown in FIGS. 7-8. The other components of the picking assembly may be substantially the same as described in reference to FIGS. 7-8 or as otherwise described herein. The assembly shown in FIGS. 7-8 includes a picking station 601 fed with pre-packaged items through the distal portion 403 of the feeder magazine 400. At the picking station 601, the picking assembly may include an arresting mechanism comprising frictional clamps 605*a* and 605*b* that are positioned over the distal portion 403 of the feeder magazine 400 and the pre-packaged items therein, which may be blisterpacks 650 of pills, vitamins, or other items, as shown in FIGS. 9-10. In the embodiment shown in FIGS. 9-10, the frictional clamps 605*a* and 605*b* may be connected to an actuation assembly 608*a*, which is moved in an up and down pattern by an electronically controlled actuator 608*b* (e.g., a pneumatic actuator) in electronic communication with electronic controller 1001.

The picking assembly may also include stop tabs 604*a* and 604*b* that are positioned over the distal portion 403 of the feeder magazine 400 and the blisterpacks 650 therein. The stop tabs may be connected to an axle 607 that may be connected to the coordinated belt system driven by the motor 530, and may therefore be mechanically coordinated with the picker head. Both the axle 607 and the actuation assembly 608*a* may be positioned on a carriage 615 that can be adjusted along a track in housing 630 that allows the picking assembly to adjust the size of the distal portion 403 of the feeder magazine 400 to accommodate pre-packaged items of various sizes. The housing 630 may include an actuator (e.g., a servo motor) in electronic communication with the electronic controller 1001 to allow the operator to adjust the vertical position of the carriage 615 to allow for pre-packaged items of different sizes.

FIG. 10 provides a close-up view of some of the internal components of the picking station 601, with the remaining sections of the feeding system 1000 removed for the sake of clarity. The leading blisterpack 650 is present at the picking station 601, to allow the picking head 502 access thereto. The picking station 601 includes frictional clamps 605*a* and 605*b* to frictionally engage the blister packs 650 to hold them in position during a picking operation. The frictional clamps 605*a* and 605*b* are positioned above the feeder magazine 400 and are moved inferiorly into the feeder magazine 400 to engage the top sides of the blisterpacks 650 during a picking operation. During the picking operation the actuator 608*b* depresses the actuation assembly 608*a* and the frictional clamps 605*a* and 605*b* as a result of their connection to the actuation assembly 608*a* The action of the actuator 608*b* may be coordinated with the motor 530 driving the integrated belt driving system. For example, an encoder associated with the motor 530 sends data regarding the revolutions in the motor 530 to the electronic controller 1001, and an algorithm pre-programmed in the electronic controller 1001 is calibrated to activate the actuator 608*b* by electronic signal at a pre-determined time such that the action of the actuator 608*b* maintains coordination with the activity of the integrated belt driving system, even in the case that the integrated belt system speeds up or slows down. Alternatively, the actuator 608*b* may be activated based on a timer coordinated with the initial activation of the motor 530.

The stop tabs 604*a* and 604*b* block the advancement of the blisterpacks 650 between picking operations. Between picking operations, the frictional clamps 605*a* and 605*b* may be disengaged to allow the pre-packaged items to advance in the feeder magazine 400, and the stop tabs 604*a* and 604*b* may be engaged to prevent the leading blisterpack or any others from spilling from the feeder magazine. The stop tabs 604*a* and 604*b* may each be a bar or plate that moves upward relative to the path of the distal portion 403 of the feeder magazine 400 during a picking operation, and down to obstruct the distal end of the distal portion 403 the feeder magazine 400 to hold the leading blisterpack in the feeder magazine 400 between picking operations. The stop tabs 604*a* and 604*b* are connected to axle 607, which may be driven cam and shaft 607*a* that may be connected to the integrated belt system driven by the motor 530, such that the timing of the engagement of the stop tabs 604*a* and 604*b* is mechanically governed in precise, coordinated manner with the other components of the picking station 601. In other embodiments, the at least one stop tab may include electronically controlled actuators (e.g., pneumatic actuators) that are in electronic communication with the electronic controller 1001, and the electronically controller activates the actuators for the stop tabs 604*a* and 604*b* with precise timing coordinated with the other components of the picking station according to a pre-programmed algorithm. Other configurations of the picking assembly are contemplated within the scope of the present invention.

The present invention concerns label and insert feeding machines for use in connection with a process of supplying inserts and/or applying labels to containers of various kinds, such as pharmaceutical bottles, jars, boxes, cartons, buckets, and other containers, vitamin bottles, jars, boxes and other containers, food and condiment containers, and various other container types. The label feeding machines of the present invention have improved efficiency, automation, speed, and reliability in comparison to conventional feeding machines. The systems of the present invention may also be highly customizable, and thus may encompass many variations from the embodiments described herein. It is to be understood that variations and modifications of the present invention may be made without departing from the scope thereof. It is to be appreciated that the features disclosed herein may be used different combinations and permutations with each other, all falling within the scope of the present invention.

The foregoing descriptions of specific embodiments of the present invention have been presented for purposes of illustration and description. They are not intended to be exhaustive or to limit the invention to the precise forms disclosed, and many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

What is claimed is:

1. A system for separating and feeding packaged items, comprising:

a. an upstream feeder magazine having a track for advancing a row of individually packaged items to a picking station disposed downstream of the feeder magazine, and b. said picking station operable to perform a picking operation which removes said individually packaged items individually from said row of individually packaged items in said feeder magazine, said picking station comprising:

i. a stop tab operable to hold a leading individually packaged item in said feeder magazine, ii. a picking mechanism operable to remove said leading individually packaged item from said feeder magazine and deliver said leading individually packaged item to a downstream location, wherein said system is operable to perform said picking operation in repetition to separate and deliver said individually packaged items individually to said downstream location;

wherein, during each picking operation, the stop tab is moved away from the feeder magazine to enable picking of said leading individually packaged item by said picking mechanism.

2. The system of claim 1, further comprising a. a collection station for removing a set of individually packaged items from a prepack package;

b. a transfer shuttle operable to grasp each end of the set and transport the set to the feeder magazine; and c. a loading station operable to be loaded with a plurality of prepack packages to create a queue to be successively moved into said collection station, and a receiving conveyor for moving said prepack packages individually into said collection station.

3. The system of claim 2, further comprising a driving mechanism for advancing the row of individually packaged items through the track, wherein said driving mechanism is operable to be repositioned along said track behind a trailing individually packaged item as said transfer shuttle adds individually packaged items into said track.

4. The system of claim 1, further comprising an arresting mechanism for preventing advancement of the row of individually packaged items through said feeder magazine, wherein said arresting mechanism is operable to (i) arrest advancement of said individually packaged items during picking operations and (ii) disengage between picking operations.

5. The system of claim 4, wherein said stop tab is operable to (i) hold said leading individually packaged item in said feeder magazine between picking operations and (ii) release said leading individually packaged item during picking operations.

6. The system of claim 5, wherein said arresting mechanism and said stop tab are engaged at separate times to facilitate removal of said leading individually packaged item individually without any trailing individually packaged items being removed from said feeder magazine.

7. The system of claim 4, wherein said picking mechanism includes a picking head that is operable to grasp said leading individually packaged item with sufficient strength to remove it from the feeder magazine while the arresting mechanism is engaged.

8. The system of claim 7, where said picking head includes a grasping structure operable to engage an exposed surface of said individually packaged item and create a partial vacuum between the grasping structure and the individually packaged item.

9. The system of claim 1, wherein said system is operable to perform picking operations at a rate of about 1 to about 10 per second.

10. A system for separating and feeding items individually, comprising:

a. an upstream feeder magazine having a track through which a row of pre-packaged items are advanced toward a picking station disposed downstream of the feeder magazine; and b. said picking station operable to perform a picking operation which removes said pre-packaged items one at a time from said feeder magazine, said picking station comprising:

i. an arresting mechanism for preventing the advancement of the row of pre-packaged items in said feeder magazine, and ii. a stop tab operable to hold a leading pre-packaged item in said feeder magazine, wherein said system is operable to perform said picking operation in repetition to separate said pre-packaged items from one another and deliver them individually to a downstream location;

wherein, during each picking operation, the stop tab is moved away from the feeder magazine to enable picking of said leading pre-packaged item.

11. The system of claim 10, further comprising a loading station operable to be loaded with a plurality of packages of said pre-packaged items to create a queue of said packages to be successively moved into a collection station, and a receiving conveyor for moving said packages individually into said collection station.

12. The system of claim 11, further comprising a transfer shuttle operable to grasp pre-packaged items from one of the packages and transport the pre-packaged items to said feeder magazine, wherein said transfer shuttle is operable to move pre-packaged items from the collection station to various positions along said track based on presence and position of pre-packaged items previously delivered to said track.

13. The system of claim 12, further comprising a driving mechanism for advancing the row of pre-packaged items through the track, wherein said driving mechanism is operable to be repositioned along said track behind a trailing pre-packaged item as said transfer shuttle adds pre-packaged items into said track.

14. The system of claim 10, wherein said arresting mechanism is operable to arrest advancement of said pre-packaged items during picking operations and is disengaged between picking operations.

15. The system of claim 14, wherein said stop tab is operable to hold said leading prepackaged item in said feeder magazine between picking operations and releases said leading pre-packaged item during picking operations.

16. The system of claim 15, wherein said arresting mechanism and said stop tab are engaged at separate times to facilitate the removal of said leading pre-packaged item individually without any trailing pre-packaged items being removed from said feeder magazine.

17. The system of claim 10, further comprising a picking mechanism operable to remove said leading pre-packaged item from said feeder magazine and deliver said pre-packaged item to the downstream location, wherein said picking mechanism includes a picking head that is operable to grasp said leading pre-packaged item with sufficient strength to remove it from the feeder magazine while the arresting mechanism is engaged.

18. A system for separating and feeding items individually, comprising:

a. a picking station operable to perform a picking operation which removes items from a queue of a plurality of items one at a time, said picking station disposed downstream of said queue and comprising:

i. an arresting mechanism for preventing advancement of the items in said queue, ii. a stop tab operable to hold a leading item in said queue, and iii. a picking mechanism operable to remove the leading item from said queue and deliver said leading item to a downstream location;

wherein said stop tab is movable relative to said queue to enable removal of the leading item by the picking mechanism.

19. The system of claim 18, wherein said queue is loaded in a feeder magazine having a track in which the queue is loaded, a driving mechanism for advancing the queue of items through the track.

20. The system of claim 18, wherein said stop tab is operable to hold said leading item in said queue between consecutive picking operations and release said leading item during picking operations.

21. The system of claim 18, wherein said arresting mechanism and said stop tab are engaged at separate times to facilitate the removal of said leading item individually without any trailing items being removed from said queue.

22. The system of claim 18, wherein said picking mechanism includes a picking head that is operable to grasp said leading item with sufficient strength to remove it from the queue while the arresting mechanism is engaged.

23. The system of claim 18, wherein the arresting mechanism includes at least one moveable wall operable to compress said plurality of items to arrest the movement of said plurality of items.

24. The system of claim 18, wherein the items are labels, inserts or blisterpacks.

* * * * *